US007579573B2

(12) United States Patent
Kohira et al.

(10) Patent No.: US 7,579,573 B2
(45) Date of Patent: Aug. 25, 2009

(54) THERMAL ACTIVATION METHOD AND THERMAL ACTIVATION DEVICE FOR A HEAT-SENSITIVE ADHESIVE SHEET

(75) Inventors: Hiroyuki Kohira, Chiba (JP); Masanori Takahashi, Chiba (JP); Yoshinori Sato, Chiba (JP); Minoru Hoshino, Chiba (JP); Tatsuya Obuchi, Chiba (JP)

(73) Assignee: Seiko Instruments Inc. (JP)

( * ) Notice: Subject to any disclaimer, the term of this patent is extended or adjusted under 35 U.S.C. 154(b) by 778 days.

(21) Appl. No.: 11/137,844

(22) Filed: May 25, 2005

(65) Prior Publication Data

US 2005/0269033 A1 Dec. 8, 2005

(30) Foreign Application Priority Data

Jun. 1, 2004 (JP) ..... 2004-163093

(51) Int. Cl.

| | |
|---|---|
| ***B65C 9/25*** | (2006.01) |
| ***B65C 9/24*** | (2006.01) |
| ***F27B 9/36*** | (2006.01) |
| ***F27B 9/40*** | (2006.01) |

(52) U.S. Cl. ..... 219/388; 219/486; 156/320; 156/345.52; 156/384; 156/499

(58) Field of Classification Search ..... None
See application file for complete search history.

(56) References Cited

U.S. PATENT DOCUMENTS 3,064,959 A * 11/1962 Eisenberg et al. ..... 156/320
6,102,097 A * 8/2000 Stempien ..... 156/359
6,501,495 B1 * 12/2002 Ichikawa et al. ..... 347/171
6,731,319 B2 * 5/2004 Ichikawa et al. ..... 347/212
7,275,880 B2 * 10/2007 Obuchi et al. ..... 347/171
2003/0117479 A1 6/2003 Ichikawa et al.

OTHER PUBLICATIONS

JP2001-225822A, Label Issuing Apparatus, Hiroshi, Feb. 17, 2000, partial translation.*

(Continued)

*Primary Examiner*—Joseph M Pelham
(74) *Attorney, Agent, or Firm*—Adams & Wilks

(57) ABSTRACT

A thermal head has heating elements that can be selectively driven independently from one another during a driving operation to directly heat, and thereby thermally activate, regions of a heat-sensitive adhesive layer of a heat-sensitive adhesive sheet while the heat-sensitive adhesive sheet is moved relative to the thermal head with the heating elements disposed in opposing relation to the respective regions of the heat-sensitive adhesive layer. All but at least one of the heating elements are selectively driven so that (a) a preselected region of the heat-sensitive adhesive layer disposed in opposing relation to each non-driven heating element is not directly heated, and thereby not directly thermally activated, by the non-driven heating element, (b) the regions of the heat-sensitive adhesive layer disposed in opposing relation to the respective driven heating elements are directly heated, and thereby directly thermally activated, by the respective driven heating elements, and (c) each preselected region of the heat-sensitive adhesive layer opposed to a non-driven heating element is thermally activated with heat transmitted from surrounding directly heated regions of the heat-sensitive adhesive layer of the heat-sensitive adhesive sheet.

14 Claims, 21 Drawing Sheets

OTHER PUBLICATIONS

Patent Abstracts of Japan, vol. 2000, No. 19, Jun. 5, 2001, EPO publication No. 2001048139, EPO publication date Feb. 20, 2001.

Patent Abstracts of Japan, vol. 2000, No. 25, Apr. 12, 2001, EPO publication No. 2001225822, EPO publication date Aug. 21, 2001.

* cited by examiner

THERMAL ACTIVATION METHOD AND THERMAL ACTIVATION DEVICE FOR A HEAT-SENSITIVE ADHESIVE SHEET

BACKGROUND OF THE INVENTION

1. Field of the Invention

The present invention relates to a method of thermally activating a heat-sensitive adhesive sheet with a heat-sensitive adhesive layer, and a thermal activation device therefor.

2. Description of the Related Art

Heat-sensitive adhesive sheets with a heat-sensitive adhesive layer that develops adhesion when heated, as those disclosed in JP 11-79152 A and JP 2003-316265 A, have been in practical use for some time now. Such heat-sensitive adhesive sheets have advantages including being easy to handle since the sheets are not adhesive prior to heating and producing no factory wastes since they do not need release paper. A thermal head, which is usually employed as a printing head in a thermal printer, is sometimes used to heat this type of heat-sensitive adhesive sheet and to thereby make its heat-sensitive adhesive layer develop adhesion. This is advantageous particularly when a heat-sensitive adhesive sheet is printable on one side, for thermal heads similar in structure can be used for printing and thermal activation. In a common thermal head, plural heating elements which can be driven separately from one another are arranged into an array.

A heat-sensitive adhesive sheet is given full adhesion by, in general, driving all heating elements which face a heat-sensitive adhesive layer of the sheet while the entire surface of the sheet is passed over the thermal head, in other words, by heating throughout the entire surface of the heat-sensitive adhesive layer. Usually, a standard driving energy to obtain desired heat generation characteristics through normal driving of one heating element is determined in advance, and each heating element receives the standard driving energy when the thermal head is driven.

In the case where a heat-sensitive adhesive sheet is required to have adhesion strong enough to prevent the sheet from peeling easily, the standard driving energy is supplied to every heating element facing a heat-sensitive adhesive layer of the sheet. On the other hand, in the case where a heat-sensitive adhesive sheet is required to have weak adhesion that allows a user to peel off the sheet by hand, the overall adhesion of the heat-sensitive adhesive sheet can be made weak by creating density data for activation and activating the sheet in accordance with the density data as disclosed in JP 2001-48139 A. A desired level of adhesion thus can be obtained by adjusting the density of a region to be activated.

As described, prior art gives a heat-sensitive adhesive sheet strong adhesion by directly heating and thermally activating the entire surface of a heat-sensitive adhesive layer of the heat-sensitive adhesive sheet by an opposing heating element. A drawback thereof is great power consumption in the thermal activation process. For instance, when a thermal activation device having a thermal head is driven by battery power, the battery will be spent in a short period of time from the thermal activation process.

Another drawback is large electric current consumption resulting from driving every heating element with the standard driving energy, which represents the amount of energy used to obtain desired heat generation characteristics through normal driving of one heating element. This means that a power source of large capacity is necessary in order to increase the speed of thermal activation and shorten the time it takes to thermally activate the entire surface of the heat-sensitive adhesive layer, and a large-capacity power source is large in size, weight and cost. If a power source of relatively small capacity is employed to reduce electric current consumption, thermal activation slows down, prolonging the time to finish thermally activating the entire surface of the heat-sensitive adhesive layer and lowering the work efficiency.

Still another drawback is that a large amount of heat is accumulated because all the heating elements facing the heat-sensitive adhesive layer are driven and generate heat until the entire surface of the heat-sensitive adhesive sheet finishes passing the thermal head. The large heat accumulation raises the temperature of the thermal head greatly and, for the purpose of protecting the thermal head, continuous use of the thermal head is limited to a short period of time. When the temperature of the thermal head reaches, for example, 80° C. or higher, the thermal activation device has to be shut down to avoid damage and transformation from heat.

The conventional thermal activation method thus has drawbacks of large power consumption, electric current consumption, and heat accumulation.

The invention disclosed by JP 2001-48139 A is capable of reducing power consumption, electric current consumption, and heat accumulation since it provides in a heat-sensitive adhesive layer a region that is not thermally activated, but this structure has been proposed in the first place to weaken the adhesion of the layer. Prior art has never produced a thermal activation device that makes a heat-sensitive adhesive sheet develop strong adhesion while cutting power consumption, electric current consumption, and heat accumulation.

SUMMARY OF THE INVENTION

The present invention has been made in view of the above, and an object of the present invention is therefore to provide a thermal activation method for a heat-sensitive adhesive sheet which makes a heat-sensitive adhesive layer develop great adhesion through thermal activation while keeping power consumption, electric current consumption, and heat accumulation low, and a thermal activation device therefor.

In a thermal activation method for a heat-sensitive adhesive sheet according to the present invention, a heat-sensitive adhesive layer of a heat-sensitive adhesive sheet is thermally activated to develop adhesion from heat generated by driving plural heating elements of a thermal head which can be driven separately from one another and which face the heat-sensitive adhesive layer, and the method is characterized by selectively driving the heating elements to create a region in the heat-sensitive adhesive sheet that is not heated by any opposing heating element and by activating the heat-sensitive adhesive layer in this region with heat transmitted from surrounding regions.

This thermal activation method can make the heat-sensitive adhesive layer develop satisfactory adhesion through thermal activation while cutting the sum of energy supplied to achieve the thermal activation.

Preferably, which of the plural heating elements stops being driven temporarily is chosen in advance and when to stop driving this heating element is set in advance in a manner that gives the region in the heat-sensitive adhesive sheet that is not heated by any opposing heating element a location and a size that allows the region to be activated by heat transmitted from surrounding regions.

The sum of driving energy applied to one heat-sensitive adhesive sheet may be kept small by setting driving energy of each heating element equal to standard driving energy of each heating element and reducing the area ratio of regions in a heat-sensitive adhesive layer of the heat-sensitive adhesive sheet that are heated by opposing heating elements. This way, the sum of the driving energy can be reduced without fail. Another way to cut the sum of driving energy applied to one heat-sensitive adhesive sheet is to set driving energy of each heating element larger than standard driving energy of each heating element and reduce the area ratio of regions in a heat-sensitive adhesive layer of the heat-sensitive adhesive sheet that are heated by opposing heating elements. In this case also, the sum of the driving energy can be reduced by suitably adjusting the area ratio of regions that are heated by opposing heating elements and the driving energy of each heating element.

When a heat-sensitive adhesive layer of a heat-sensitive adhesive sheet is regarded as a matrix of dots each of which is sized to a heat generating portion of one heating element, it is preferable to give the size of 1 dot to the region that is not heated by any opposing heating element whereas, of 8 dots of regions surrounding this region, at least 4 dots of regions that are not adjacent to one another are heated by opposing heating elements. With this method, it is easy to make a heat-sensitive adhesive layer develop satisfactory adhesion through thermal activation while cutting the sum of driving energy. A particularly high reliability in adhesion development is obtained by heating, with opposing heating elements, all of the 8 dots of regions surrounding the region that is not heated by any opposing heating element.

A region in a heat-sensitive adhesive sheet that is to develop adhesion can have strong adhesion throughout when a heat-sensitive adhesive layer in this region is thermally activated throughout the region. If a heat-sensitive adhesive sheet has a region where adhesion should not be developed, a heating element that faces this region is not driven and no portion of a heat-sensitive adhesive layer in this region is thermally activated. In short, the thermal activation method described above is capable of creating an adhesive portion and a non-adhesive portion in the same heat-sensitive adhesive sheet through selective thermal activation, so that, for example, the adhesive portion is stuck fast to an article as a label and the non-adhesive portion is readily torn off as a copy of the label.

A thermal activation device for a heat-sensitive adhesive sheet according to the present invention is composed of a thermal head having plural heating elements which can be driven separately from one another; a conveying device for moving relative to the thermal head a heat-sensitive adhesive sheet which has a heat-sensitive adhesive layer in a direction intersecting a direction in which the heating elements of the thermal head are aligned; and a control device which synchronizes driving of the respective heating elements of the thermal head with movement of the heat-sensitive adhesive sheet relative to the thermal head and which stops, temporarily, at a given timing, driving a chosen few of the heating elements, and the thermal activation device creates in the heat-sensitive adhesive sheet a region that is not heated by any opposing heating element and thermally activates the heat-sensitive adhesive layer in this region with heat transmitted from surrounding regions. With this thermal activation device, the above-described thermal activation method of the present invention can readily be carried out.

The present invention is capable of thermally activating a heat-sensitive adhesive layer of a heat-sensitive adhesive sheet and thereby making the layer develop satisfactory adhesion while cutting the sum of energy spent for the thermal activation. Thermal activation according to the present invention is thus energy-efficient, and it is how the present invention reduces power consumption, electric current consumption, and heat accumulation. It is also possible for the present invention to raise the activation speed or, in the case where thermal activation is to be performed in succession, prolong the duration in which a thermal activation device is driven, by keeping power consumption and electric current consumption constant.

DETAILED DESCRIPTION OF THE PREFERRED EMBODIMENTS

An embodiment of the present invention will be described below with reference to accompanying drawings.

First Embodiment

Figure 1:
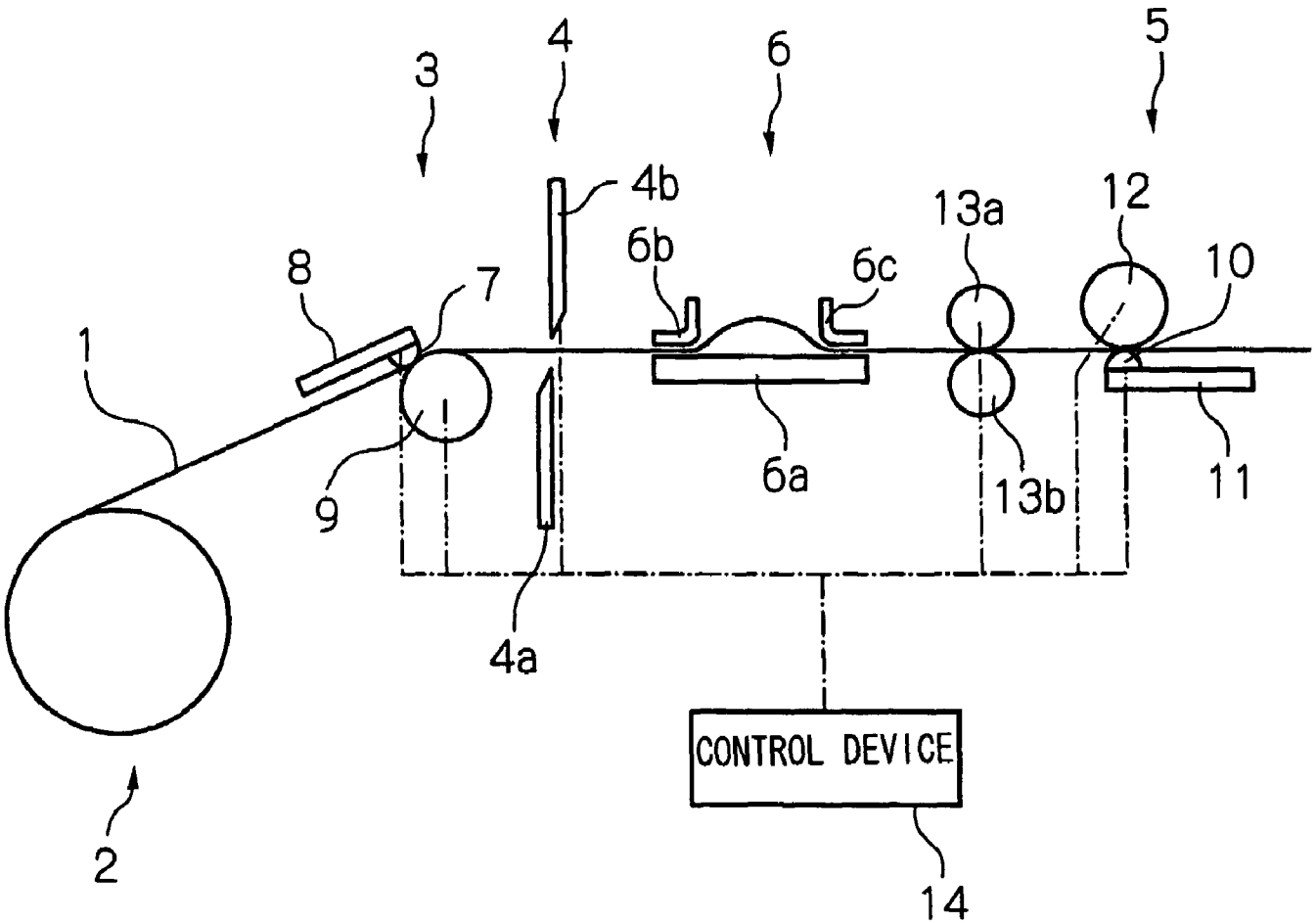
FIG. 1 is a schematic diagram showing the basic structure of a printer for a heat-sensitive adhesive sheet in which a thermal activation device of the present invention is incorporated.

A brief description will be given first on the basic structure of a printer for a heat-sensitive adhesive sheet in which a thermal activation device of this embodiment is incorporated. As schematically shown in FIG. 1, this printer for a heat-sensitive adhesive sheet is composed of a roll housing unit 2 for holding a heat-sensitive adhesive sheet 1 that is wound into a roll; a printing unit 3 for printing on a printable layer 1*d* (see FIG. 2) of the heat-sensitive adhesive sheet 1; a cutter unit 4 for cutting the heat-sensitive adhesive sheet 1 into a given length; a thermal activation unit 5 which thermally activates a heat-sensitive adhesive layer 1*a* (see FIG. 2) of the heat-sensitive adhesive sheet 1 and which constitutes the main part of the thermal activation device of this embodiment; a guide unit 6 for guiding the heat-sensitive adhesive sheet 1 along a path from the cutter unit 4 to the thermal activation unit 5; and other components. While in practice the heat-sensitive adhesive sheet 1 is cut by the cutter unit 4 into a short, label-like piece, which is then conveyed to the downstream of the cutter unit 4, FIG. 1 shows the heat-sensitive adhesive sheet 1 in a long and uncut state downstream of the cutter unit 4 for easy understanding of the path along which the heat-sensitive adhesive sheet 1 is conveyed.

Figure 2:
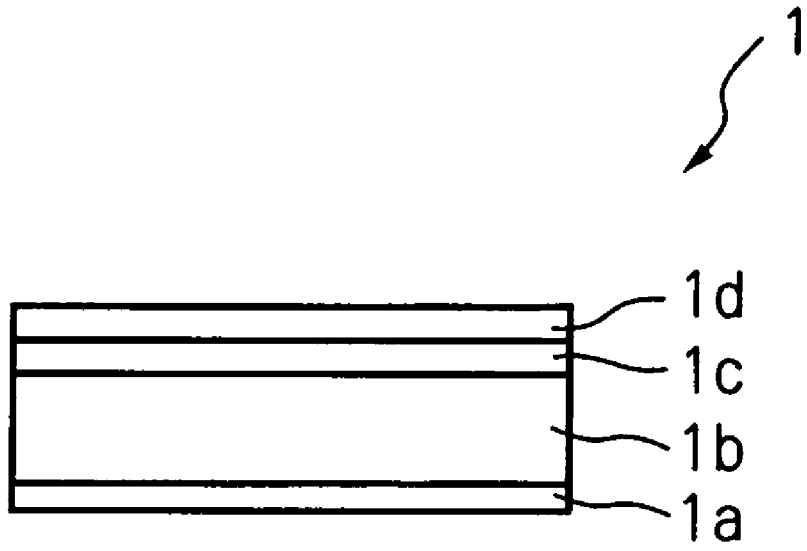
FIG. 2 is an enlarged side view showing an example of a heat-sensitive adhesive sheet used in the present invention.

The heat-sensitive adhesive sheet 1 used in this embodiment is composed of, for example, as shown in FIG. 2, a substrate 1*b* having a heat insulating layer 1*c* and a heat-sensitive color-developing layer (printable layer) 1*d* on the front side and a heat-sensitive adhesive layer 1*a* on the back side. The heat-sensitive adhesive layer 1*a* is obtained by applying a heat-sensitive adhesive agent that has thermoplastic resin, solid plastic resin or the like as its main ingredient, and drying the agent until it solidifies. However, the heat-sensitive adhesive sheet 1 is not limited to this structure and various modifications can be made as long as the heat-sensitive adhesive sheet 1 has the heat-sensitive adhesive layer 1*a*. For instance, a heat-sensitive adhesive sheet employable as the heat-sensitive adhesive sheet 1 may not have the heat insulating layer 1*c*, or may have a protective layer or a colored printed layer (a layer on which letters, images and the like are printed in advance) on the surface of the printable layer 1*d*, or may have a thermal coating.

The printing unit 3 is composed of a printing thermal head 8 having plural heating elements 7 which are relatively small resistors arranged in the width direction (a direction vertical to FIG. 1) for dot printing, a printing platen roller 9 pressed against the printing thermal head 8, and other components. The heating elements 7 can have the structure of heating elements for a printing head of known thermal printers, for example, a structure in which a protective film made of crystallized glass covers the surfaces of plural heating resistors formed on a ceramic substrate or the like with the use of thin film technologies, and therefore a detailed description on the heating elements 7 will be omitted here. The printing thermal head 8 is positioned to come into contact with the printable layer 1*d* of the heat-sensitive adhesive sheet 1. The printing platen roller 9 is pressed against the printing thermal head 8.

The cutter unit 4 is for cutting the heat-sensitive adhesive sheet 1, on which the printing unit 3 has printed, into a given length. The cutter unit 4 is composed of a movable blade 4*a* operated by a driving source (omitted from the drawing), a stationary blade 4*b* opposing the movable blade 4*a*, and other components.

The guide unit 6 is composed of a plate-like guide (first guide) 6*a* placed under a conveying path from the cutter unit 4 to the thermal activation unit 5, and a pair of second guides 6*b* and 6*c* placed at a forwarding portion of the cutter unit 4 and an insertion portion of the thermal activation unit 5, respectively. The second guides 6*b* and 6*c* are bent upward substantially at right angles. The guide unit 6 leads the heat-sensitive adhesive sheet 1 into the thermal activation unit 5 smoothly, and also holds the heat-sensitive adhesive sheet 1 in a temporarily sagged state downstream of the cutter unit 4 to enable the cutter 4 to cut the heat-sensitive adhesive sheet 1 into a desired length.

The thermal activation unit 5 has a thermal activation thermal head 11 with plural heating elements 10 lined up in the width direction, and a thermal activation platen roller 12. The thermal activation thermal head 11 has the same structure as that of the printing thermal head 8, namely, the structure of a printing head of known thermal printers including one in which a protective film made of crystallized glass covers the surfaces of plural heating resistors formed on a ceramic substrate. With the thermal activation thermal head 11 having the structure of the printing thermal head 8, the thermal heads 11 and 8 can share parts and thus the cost can be reduced. Another advantage is that, having many small heating elements (heating resistors) 10, the thermal activation thermal head 11 is capable of heating a large surface area evenly with ease compared to a single (or a very few), large heating element. The thermal activation thermal head 11 faces the opposite direction from the printing thermal head 8, and is positioned to come into contact with the heat-sensitive adhesive layer 1*a* of the heat-sensitive adhesive sheet 1. The thermal activation platen roller 12 is pressed against the thermal activation thermal head 11.

A pair of pull-in rollers 13*a* and 13*b* for reeling in a piece of the heat-sensitive adhesive sheet 1 that has been cut by the cutter unit 4 is provided upstream of the thermal activation thermal head 11. The pull-in rollers 13*a* and 13, the printing platen roller 9, and the thermal activation platen roller 12 constitute a conveying device which conveys the heat-sensitive adhesive sheet 1 throughout the printer for a heat-sensitive adhesive sheet.

The printer for a heat-sensitive adhesive sheet also has a control device 14, which is schematically shown in FIG. 1. The control device 14 drives the conveying device (the rollers 13*a*, 13*b*, 9 and 12), the movable blade 4*b*, the printing thermal head 8, the thermal activation thermal head 11, and other components of the printer, and controls the operation of these components. The control device 14 drives the conveying device and the printing thermal head in sync with each other to alternately convey and print on the heat-sensitive adhesive sheet 1 until the heat-sensitive adhesive sheet 1 is printed on for its entire length. The control device 14 drives the thermal activation thermal head 11 in sync with the conveying device based on preset driving pattern and driving energy described below to carry out a thermal activation method of the present invention. Setting for the driving pattern and the driving energy specifically means choosing in advance a heating element of the heating elements which temporarily stops driving, and setting in advance a timing at which the driving of the heating element stops, in such a manner that a region that is not heated by any opposing heating element in the heat-sensitive adhesive sheet has its location and size to be thermally activated with heat transmitted from surrounding regions.

Given below is a brief description on the basic steps of a method of creating a desired adhesive label or the like from the heat-sensitive adhesive sheet 1 with the use of the thus structured printer for a heat-sensitive adhesive sheet.

First, the heat-sensitive adhesive sheet 1 pulled out of the roll housing unit 2 is inserted between the printing thermal head 8 and platen roller 9 of the printing unit 3. With a supply of a print signal from the control device 14 to the printing thermal head 8, the plural heating elements 7 of the printing thermal head 8 are selectively driven at an appropriate timing to generate heat and print on the printable layer 1*d* of the heat-sensitive adhesive sheet 1. In sync with the driving of the printing thermal head 8, the platen roller 9 is driven and rotated to convey the heat-sensitive adhesive sheet 1 in a direction intersecting the direction in which the heating elements 7 of the printing thermal head 8 are aligned, for example, the sheet is conveyed in a direction perpendicular to the array of the heating elements 7. Specifically, one line of printing by the printing thermal head 8 and conveyance of the heat-sensitive adhesive sheet 1 by the platen roller 9 by a given amount (one line, for example) are alternated to print predetermined letters, images and the like on the heat-sensitive adhesive sheet 1.

The heat-sensitive adhesive sheet 1 thus printed on passes between the movable blade 4*a* and stationary blade 4*b* of the cutter unit 4 and then reaches the guide unit 6. In the guide unit 6, the heat-sensitive adhesive sheet 1 is bowed as necessary to set the length of the heat-sensitive adhesive sheet 1 from its leading end to the point between the movable blade 4*a* and stationary blade 4*b* of the cutter unit 4. For instance, in the case where the length of an adhesive label to be created is longer than the shortest distance from the pull-in rollers 13*a* and 13*b* to the movable blade 4*a* and stationary blade 4*b* of the cutter unit 4, the rotation of the pull-in rollers 13*a* and 13*b* is halted and the platen roller 9 is rotated with the leading end of the heat-sensitive adhesive sheet 1 held between the stilled rollers 13*a* and 13*b*. This allows the heat-sensitive adhesive sheet 1 to bow in the guide unit 6 until the length of the heat-sensitive adhesive sheet 1 from its leading end to the point between the movable blade 4*a* and stationary blade 4*b* of the cutter unit 4 becomes a predetermined length. Then the movable blade 4*a* is driven to cut the heat-sensitive adhesive sheet 1.

Next, the paired pull-in rollers 13*a* and 13*b* are rotated to send, to the thermal activation unit 5, the label-like piece of the heat-sensitive adhesive sheet 1 that has been printed on as necessary and cut into a given length in the manner described above. The control device 14 drives the thermal activation thermal head 11 while the label-like piece of the heat-sensitive adhesive sheet 1 is held between the thermal activation thermal head 11 and the platen roller 12 in the thermal activation unit 5. The heat-sensitive adhesive layer 1*a* in contact with the thermal activation thermal head 11 is thus heated and activated. The rotation of the platen roller 12 forwards the label-like piece of the heat-sensitive adhesive sheet 1 with the entire surface of the heat-sensitive adhesive layer 1*a* pressed against the thermal activation thermal head 11 until the label passes the thermal activation thermal head 11. As a result of taking into consideration the driving time of the heating elements 10 for one time and the moving speed of the heat-sensitive adhesive sheet 1 relative to the heating elements 10 of the heat-sensitive adhesive sheet 1, the heat-sensitive adhesive sheet 1 is moved continuously when the driving time of the heating elements 10 for one time is short whereas the heat-sensitive adhesive sheet 1 is moved intermittently in a manner that stops conveyance of the heat-sensitive adhesive sheet 1 each time the heating element 10 is driven for one time when the driving time of the heating elements 10 for one time is long.

In this way, a given length of adhesive label having predetermined letters, images and the like printed on one side and having developed adhesion on the other side is created from the heat-sensitive adhesive sheet 1.

The present invention cuts the sum of energy required for thermal activation of the heat-sensitive adhesive sheet 1, without sacrificing adhesion, by having the control device 14 drive the thermal activation thermal head 11 in sync with movement of the heat-sensitive adhesive sheet 1 conveyed by the platen roller 12 and by stopping driving a chosen few of the many heating elements 10 at a given timing (in other words, by selectively halting heat generation).

Specifically, the inventors of the present invention have found that, when one or more of the many heating elements 10 aligned stop being driven (stop generating heat), a region in the heat-sensitive adhesive sheet 1 that is not heated directly by any of opposing heating elements 10 can be thermally activated with heat transmitted from the surrounding heating elements 10. The inventors of the present invention believe that arranging such regions strategically lowers the amount of energy consumed in thermal activation.

Conventionally, it has been common to supply standard driving energy required to drive one heating element to every heating element that is provided in the thermal activation thermal head 11. However, in the case where many heating elements 10 are arranged at high density, each region of the heat-sensitive adhesive sheet 1 receives heat from not only its opposing heating element but also neighboring heating elements 10 and, accordingly, the sum of standard driving energy supplied to every heating element of the thermal activation thermal head 11 as the energy required to drive one heating element often surpasses the minimum energy necessary to thermally activate one heat-sensitive adhesive sheet 1. In other words, the driving energy that is minimum for one heating element can be excessive as a whole (the thermal activation thermal head 11) when supplied to every one of the many, densely disposed heating elements 10. Although it is possible to cut back the energy supplied to each of the heating elements 10 taking into account the density of the many heating elements 10, calculating the actual minimum driving energy on the basis of the density of the heating elements 10 is a very laborious and difficult work. Instead, the inventors of the present invention have thought of an easy way of improving the energy efficiency without laborious calculations which cuts the total energy consumption by stopping driving chosen one or more of the heating elements 10 (by selectively halting heat generation) while keeping the driving energy supplied to each of the heating elements 10 the same.

Based on the above speculations, the control device 14 in the present invention stops driving a chosen few of heating elements 10 at a given timing during the thermal activation process.

For easy understanding, suppose here that the entire surface of the heat-sensitive adhesive layer 1*a* in one label-like piece of the heat-sensitive adhesive sheet 1 forms a matrix of dots, which correspond to the respective heating elements 10. Lateral lines in a matrix of FIGS. 3A and 3B and FIGS. 4A and 4B correspond to the respective heating elements 10 of the thermal activation thermal head 11, whereas longitudinal lines in the matrix correspond to the amount of movement of the heat-sensitive adhesive sheet 1 relative to the thermal activation thermal head 11. Therefore, the length in the lateral direction of one dot in the matrix represents the dimensions of each of the heating elements 10. The length in the longitudinal direction of one dot represents, in length, how much of the heat-sensitive adhesive sheet 1 has passed a point opposite the heating element in question while this heating element is driven once. Each dot in the schematic diagrams is assumed here as a square for conveniences' sake, and the matrix has 10×10 dots. In practice, the heat-sensitive adhesive sheet 1 is usually larger in size than the matrix shown in FIGS. 3A and 3B. Just think that there are many such matrices in lengthwise and crosswise directions in one heat-sensitive adhesive sheet.

Figure 3:
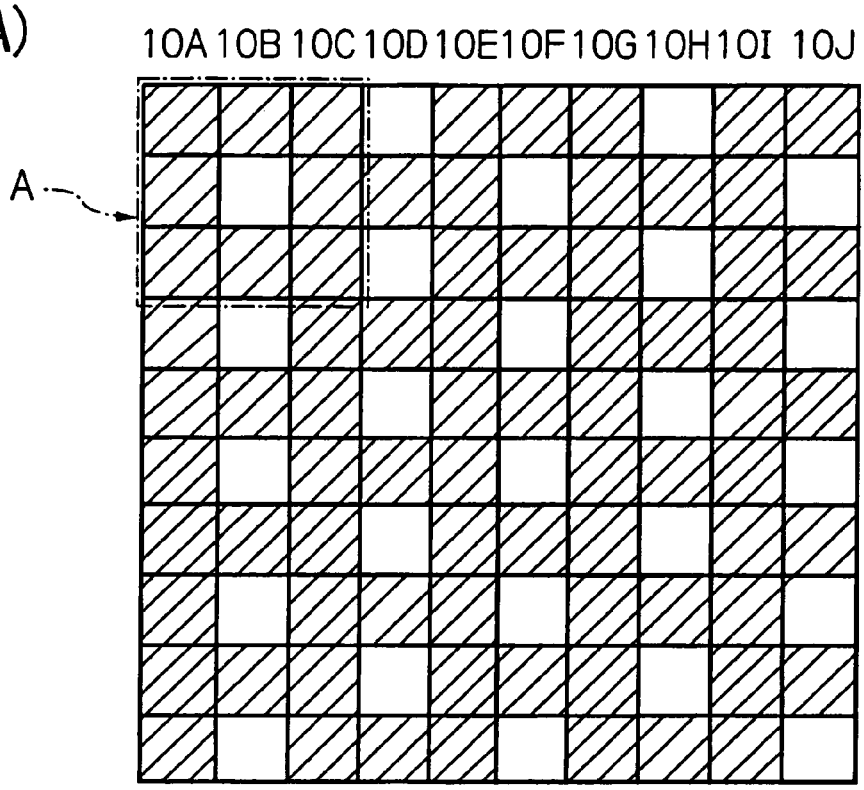
FIGS. 3A and 3B are, respectively, a schematic diagram showing in the form of matrix a driving pattern of a thermal activation method according to a first embodiment of the present invention and a schematic diagram showing in the form of matrix which region is activated by the thermal activation method.
Figure 3:
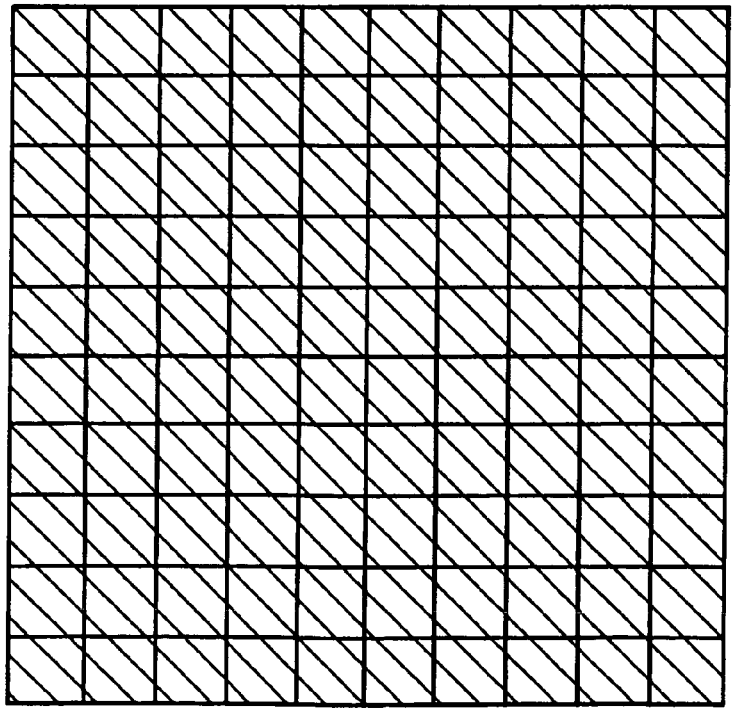
Figure 4:
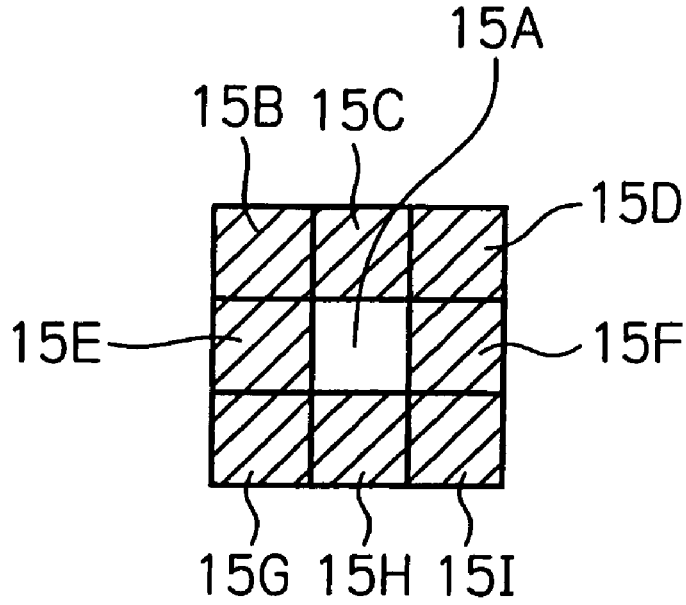
FIGS. 4A and 4B are, respectively, a schematic diagram showing a part of FIG. 3A and a schematic diagram illustrating which region is activated in FIG. 4A.
Figure 4:
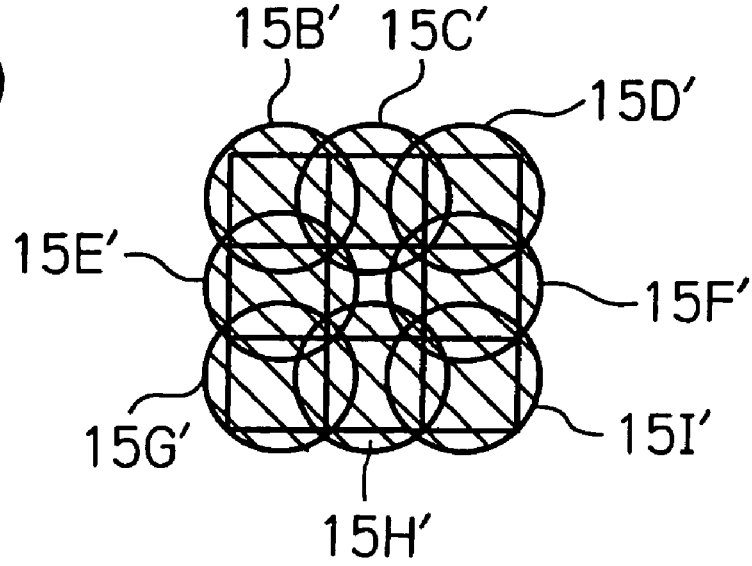
Figure 5:
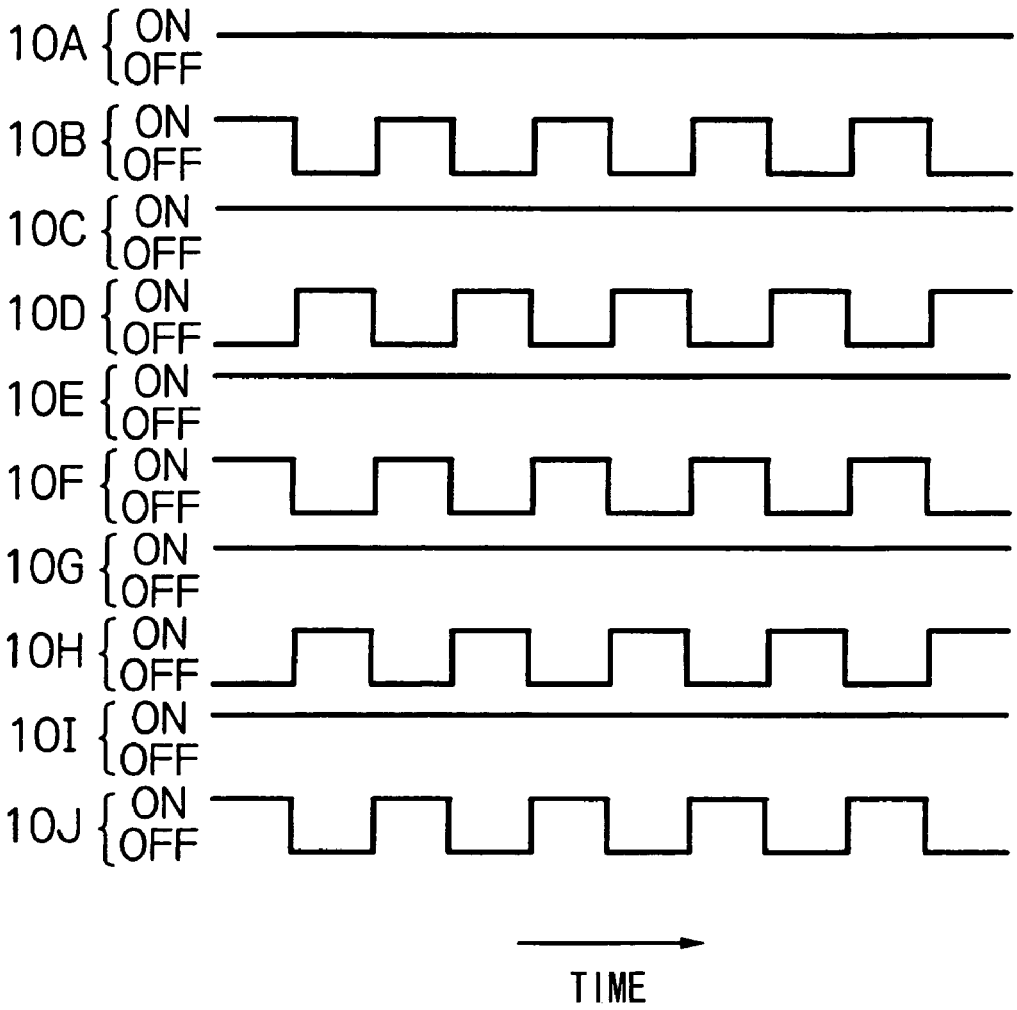
FIG. 5 is a time chart showing how each heating element is driven in order to achieve the driving pattern shown in FIG. 3A.

In FIG. 3A, hatched regions represent the heating elements 10 generating heat (being driven) to show a driving pattern of the heating elements. Other regions than the hatched regions are directly heated by none of the opposing heating elements 10. In this embodiment, as shown in FIG. 3A, the regions that are directly heated by none of the opposing heating elements 10 (other regions than the hatched regions) are arranged regularly. Each of these indirectly heated regions and surrounding regions make a square of 3×3=9 dots, an area A of FIG. 3A, which is shown in FIG. 4A. In the area A, 8 dots of regions 15B to 15I surrounding an indirectly heated region 15A are all regions that are directly heated by their opposing heating elements (hatched regions). A method of driving the heating elements 10 in a manner that produces the matrix pattern of FIG. 3A is shown in a time chart of FIG. 5. For conveniences' sake, reference symbols 10A to 10J are assigned to the heating elements constituting the matrix of FIG. 3A in order from the left of FIG. 3A. As shown in FIG. 5, a group consisting of the heating elements 10B, 10F and 10J and a group consisting of the heating elements 10D and 10H alternately stop being driven whereas the heating elements 10A, 10C, 10E, 10G and 10I are driven all the time to obtain the driving pattern shown in FIG. 3A.

When heated in accordance with the driving pattern of FIG. 3A, the heat-sensitive adhesive layer 1*a* of the heat-sensitive adhesive sheet 1 is thermally activated throughout the entire surface as shown in FIG. 3B (hatched regions in FIG. 3B represent thermally activated regions). The mechanism thereof will be described with reference to FIG. 4B. As the heating elements 10 are driven to generate heat, portions of the heat-sensitive adhesive layer 1*a* of the heat-sensitive adhesive sheet 1 that are directly opposite the heating elements 10 are thermally activated and, at the same time, other portions are thermally activated by heat transmitted from neighboring heating elements through the heat-sensitive adhesive layer 1*a*. In FIG. 4B, ranges 15B' to 15I' marked by perfect circles schematically show how far heat is transmitted from the heating elements 10 opposing the regions 15B to 15I. Heat generated by a heating element spreads radially from a region that is directly opposite the heating element and reaches outside of the region. The heat-sensitive adhesive sheet 1 shown in FIG. 2, in particular, causes heat to spread far into surrounding regions because the heat insulating layer 1*c* in the middle does not allow heat to diffuse in the depth direction.

As is obvious from FIG. 4B, the region 15A, despite being heated directly by none of the opposing heating elements 10, is activated with heat transmitted from the surrounding regions (8 dots of regions) 15B to 15I.

Although the region 15A of FIG. 4B has a blanc portion (non-activated portion) in the middle, it is simply a result of marking the heat conductive ranges 15B' to 15I' with perfect circles for easy understanding, and the heat actually spreads in a more complicated pattern, activating every region throughout. A schematic diagram like this is as a rule only capable of limited extent of accuracy but, nevertheless, portions where the heat conductive ranges 15B' to 15I' overlap with one another can transmit heat farther than the circled portions because of the synergistic effect of heat from plural heating elements, and thus all the regions are thermally activated.

As has been described, according to this embodiment, one fourth of the entire region is not directly heated by any of the opposing heating elements 10 as shown in FIG. 3A. The ratio of heating elements driven (activation ratio) is therefore 75%, and the sum of energy given to all the heating elements 10 is 75% of that of prior art.

Figure 6:
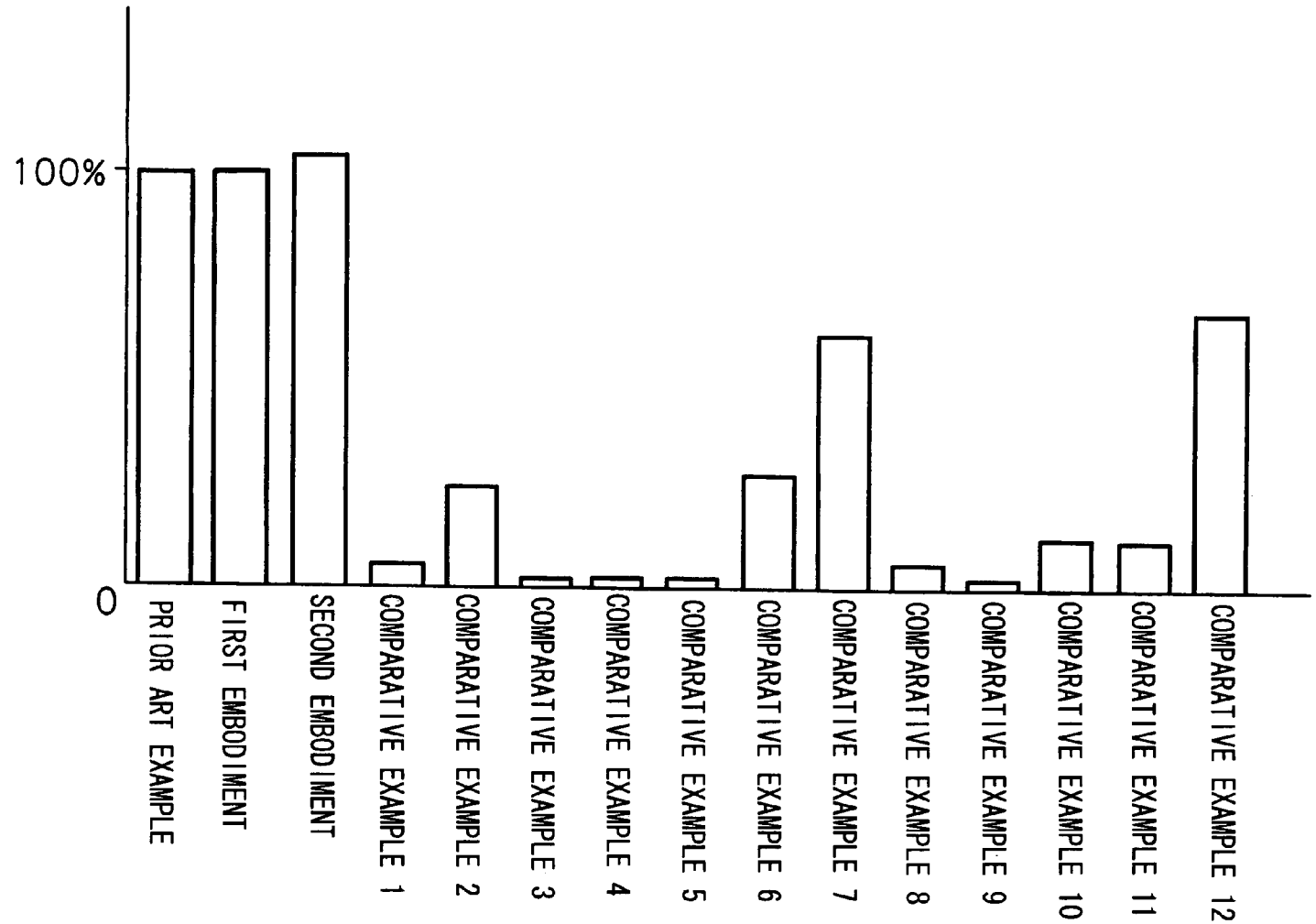
FIG. 6 is a graph showing the sticking power of a prior art example, two embodiments of the present invention, and twelve comparative examples in comparison to one another.

FIG. 6 shows the sticking power according to this embodiment in comparison with a second embodiment and Comparative Examples 1 to 12, which will be described later, and a prior art example. The prior art example here refers to a sample that is obtained by supplying standard driving energy, which is necessary to drive one heating element, to each and every heating element and by heating the entire region of a heat-sensitive adhesive layer directly with opposing heating elements. The amount of energy supplied to the respective heating elements is changed, generally, by changing the pulse width of the supply energy, in other words, by changing the length of time in which the respective heating elements are driven with the supplied energy. The driving method of the prior art example is expressed as pulse width 100%×activation ratio 100%. In FIG. 6, the sticking power refers to a force required to peel heat-sensitive adhesive sheets, which have been thermally activated in accordance with the respective embodiments and examples, off of a reference member such as paper. Numerical values representing the sticking power are greatly influenced by characteristics and materials of heat-sensitive adhesive layers, the material of the reference member, environmental temperature and other similar conditions during the experiment, the direction in which the sheets are pulled, etc. Therefore, the sticking power here is expressed not in units but by relative values with the sticking power according to the prior art example in which satisfactory adhesion is obtained as 100%.

FIG. 6 shows that the first embodiment provides as strong sticking power as the prior art example, and it proves that the entire surface of the heat-sensitive adhesive layer 1*a* is thermally activated in the first embodiment.

Figure 7:
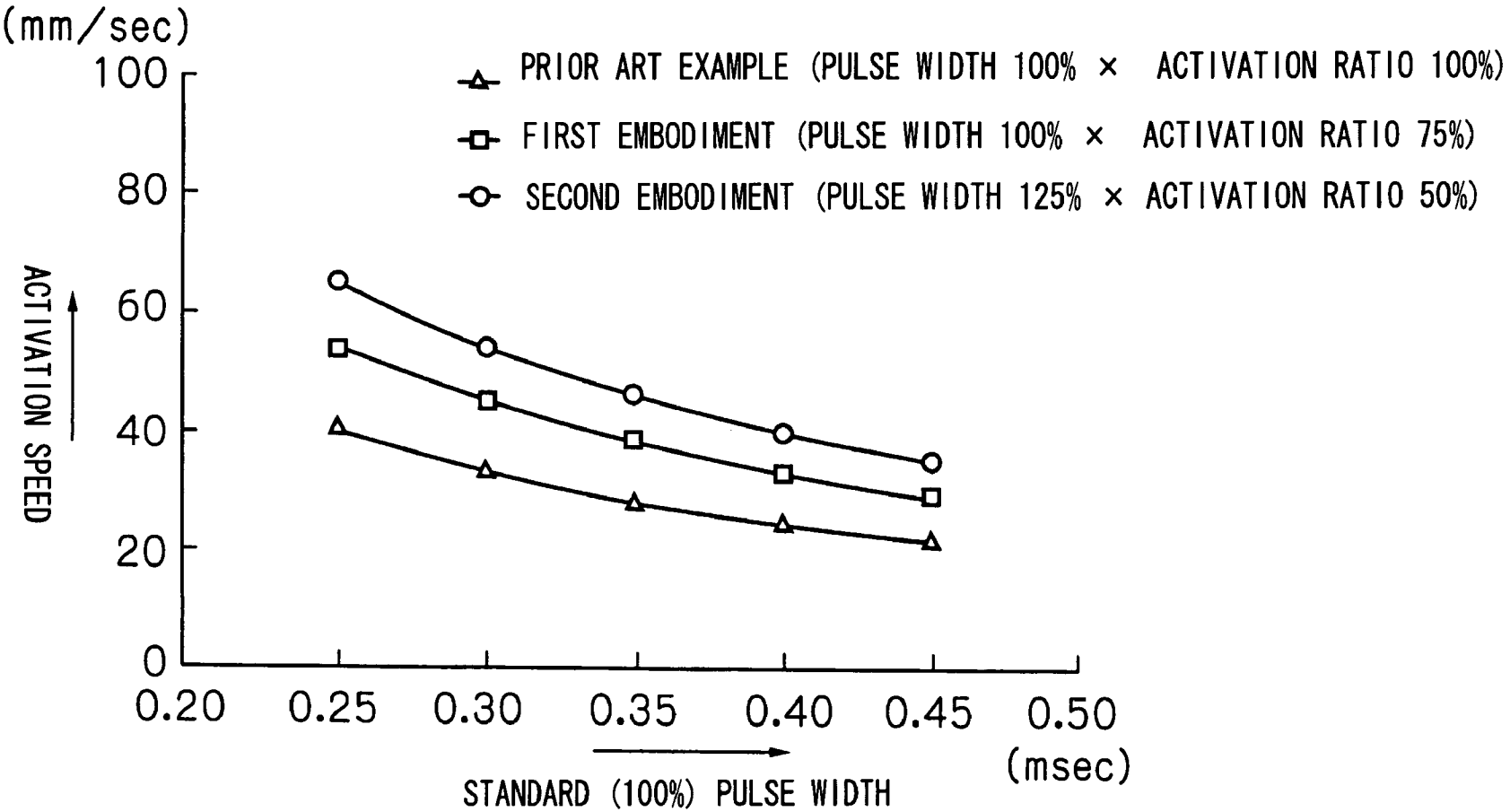
FIG. 7 is a graph showing the activation speed of the prior art example and two embodiments of the present invention in comparison to one another.

FIG. 7 shows the thermal activation speed obtained in accordance with this embodiment and the second embodiment with the use of the same thermal activation thermal head 11 in comparison with the prior art example. The term activation speed refers to the relative speed of the heat-sensitive adhesive sheet 1 moved relative to the thermal activation thermal head 11 to give the heat-sensitive adhesive layer 1*a* through thermal activation. If the heat-sensitive adhesive sheet 1 is moved relative to the thermal activation thermal head 11 at a speed faster than the thermal activation speed plotted here, thorough thermal activation is not obtained and satisfactory adhesion is not developed. Shown in FIG. 7 are results of five variations of an experiment in which standard driving energy supplied to one heating element is changed from 0.25 to 0.45, so that the 100% pulse width is set to 0.25 to 0.45.

It is understood from FIG. 7 that the first embodiment is the same as the prior art example in pulse width (100%) but is faster inactivation speed at all the five different standard pulse widths. This is because the first embodiment having a smaller activation ratio finishes thermal activation in a shorter period of time if the electric current consumption is the same. The electric current consumption in this embodiment can be reduced by keeping the activation speed constant.

Figure 8:
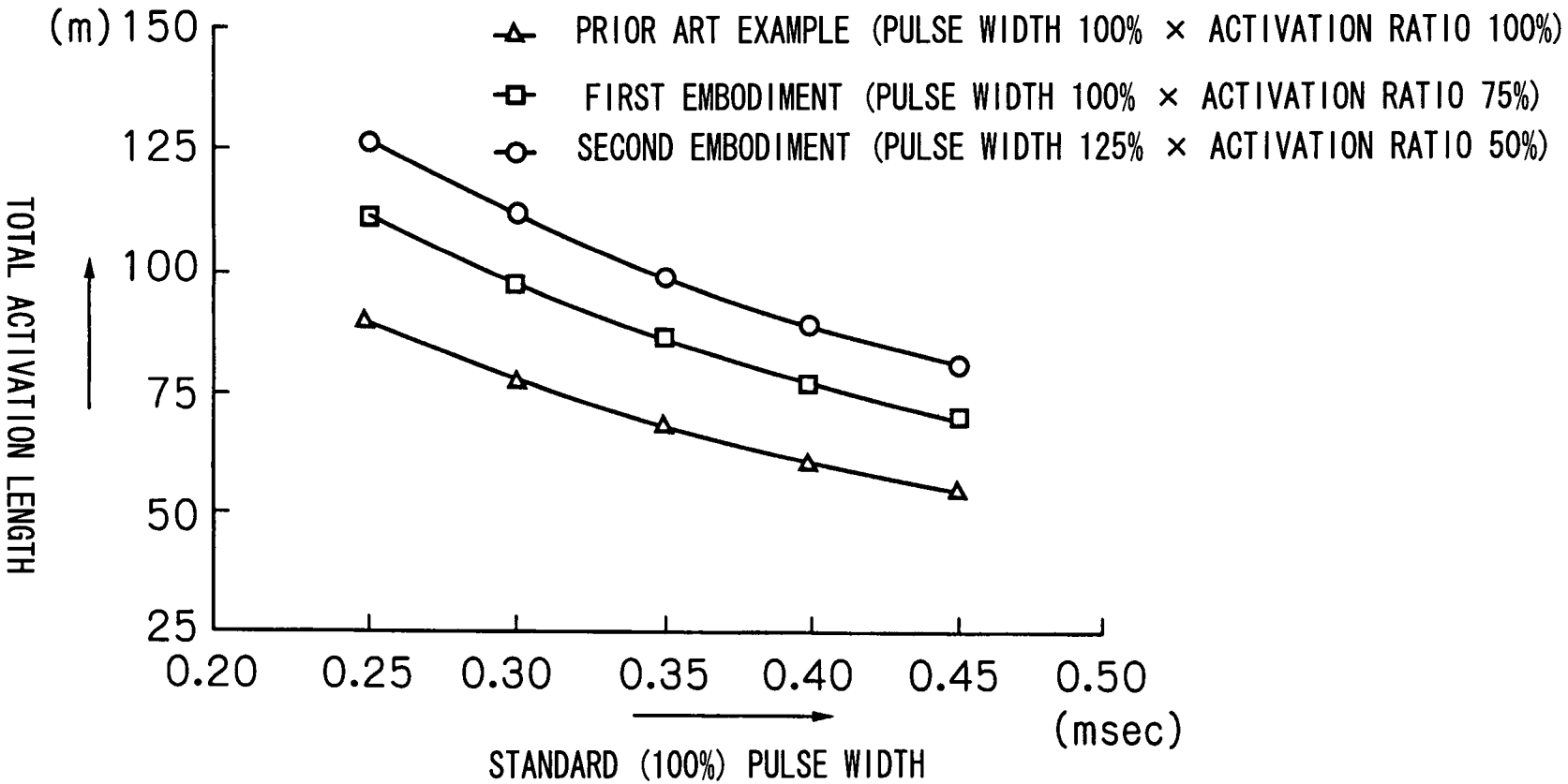
FIG. 8 is a graph showing the total activation length of the prior art example and two embodiments of the present invention in comparison to one another.

FIG. 8 shows the total activation length obtained in accordance with this embodiment and the second embodiment with the use of the same thermal activation thermal head 11 in comparison with the prior art example. The total activation length is the duration in which the thermal activation thermal head 11 can be driven to thermally activate the heat-sensitive adhesive layer 1*a*, and is expressed by how far the heat-sensitive adhesive sheet 1 is moved relative to the thermal activation thermal head 11. Here, the total amount of the heat-sensitive adhesive sheet 1 that is thermally activated in succession at a constant activation speed with the use of the same battery for the driving source of the thermal activation thermal head 11 is expressed in the length in the sheet conveying direction as the total activation length. If the heat-sensitive adhesive sheet 1 is thermally activated for a length longer than the one plotted here, the battery is completely spent and the thermal activation thermal head 11 cannot be driven any longer. As in FIG. 7, the experiment here has five variations in which standard driving energy supplied to one heating element is changed from 0.25 to 0.45, so that the 100% pulse width is set to 0.25 to 0.45.

It is understood from FIG. 8 that the first embodiment is the same as the prior art example in pulse width (100%) but is longer in total activation length at all the five different standard pulse widths. This is because thermal activation in the first embodiment having a smaller activation can last longer while consuming the same amount of electric current. The electric current consumption in this embodiment can be reduced by keeping the total activation length constant.

Second Embodiment

The second embodiment of the present invention will be described next. This embodiment also employs the same printer for a heat-sensitive adhesive sheet (see FIG. 1) that is used in the first embodiment to perform the thermal activation described above. The difference between the two embodiments is that the driving pattern and driving energy of the heating elements 10 are set differently. Given below is a description on the driving pattern and driving energy for thermal activation in this embodiment. Other aspects of the thermal activation method, the structure of the thermal activation device, and the like are identical with those in the first embodiment and descriptions thereof are omitted here.

Figure 9:
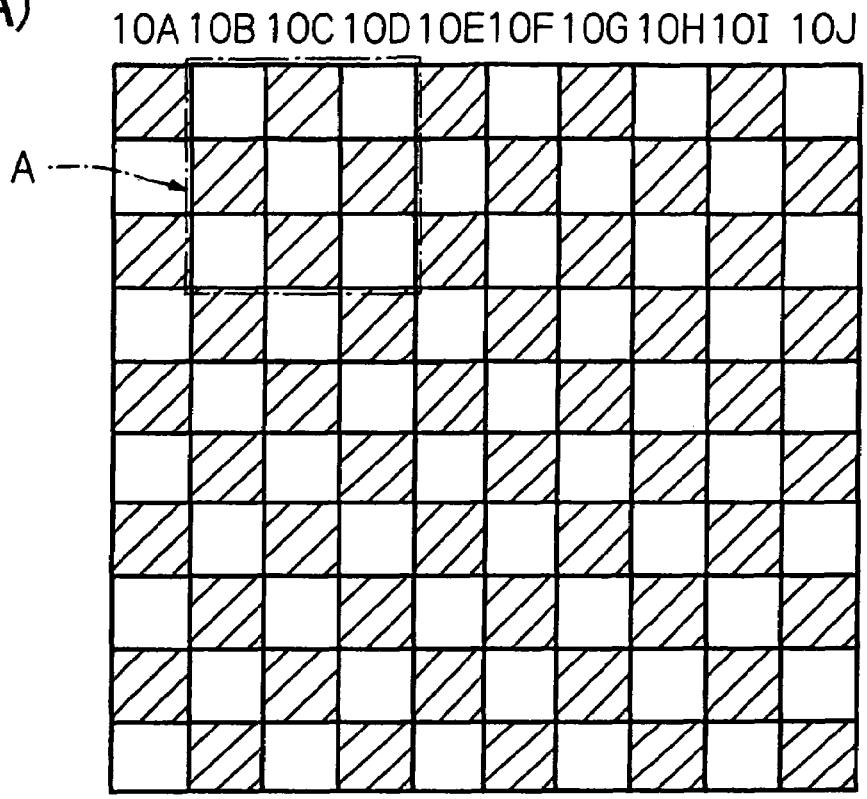
FIGS. 9A and 9B are, respectively, a schematic diagram showing in the form of matrix a driving pattern of a thermal activation method according to a second embodiment of the present invention and a schematic diagram showing in the form of matrix which region is activated by the thermal activation method.
Figure 9:
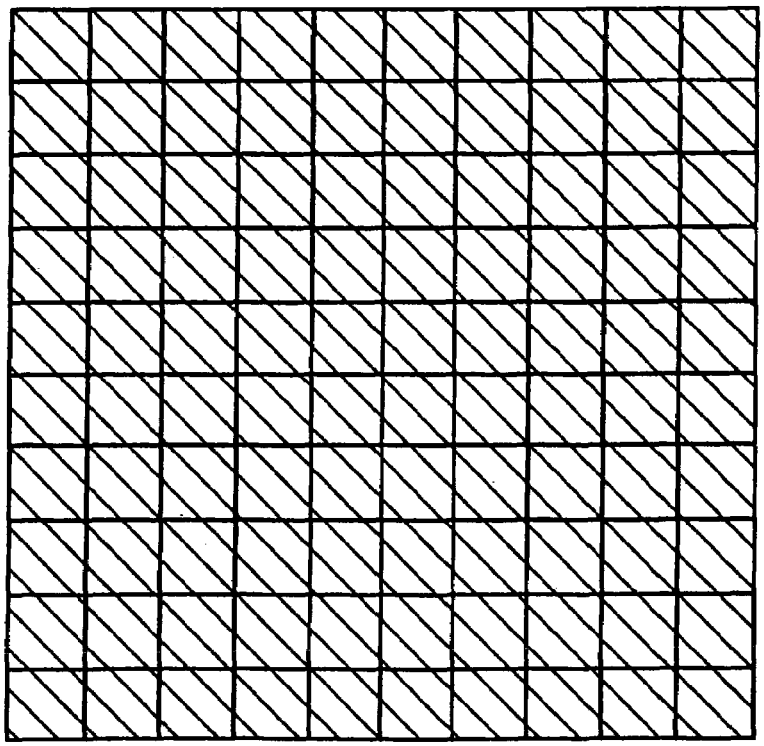
Figure 10:
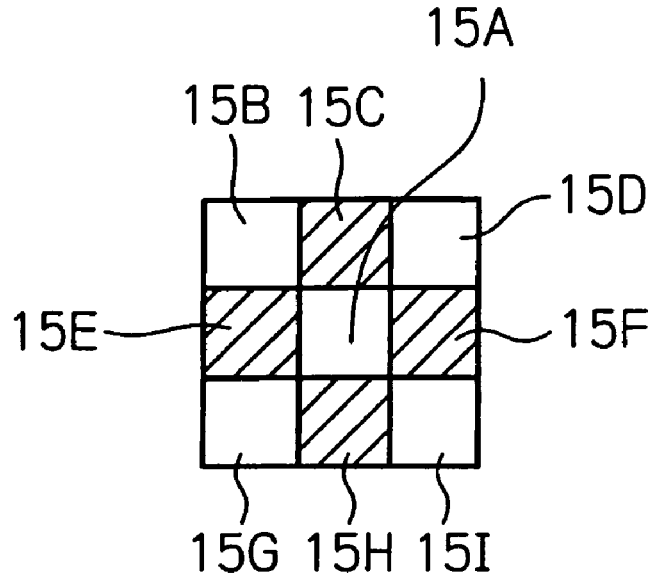
FIGS. 10A and 10B are, respectively, a schematic diagram showing a part of FIG. 9A and a schematic diagram illustrating which region is activated in FIG. 10A.
Figure 10:
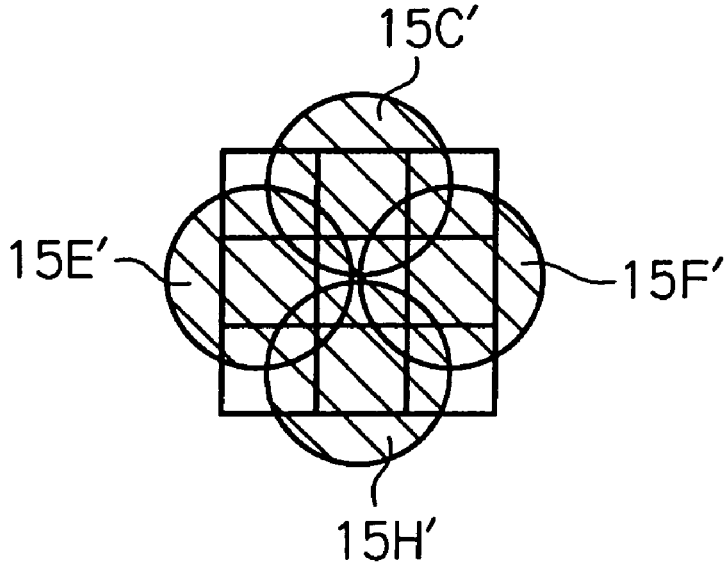
Figure 11:
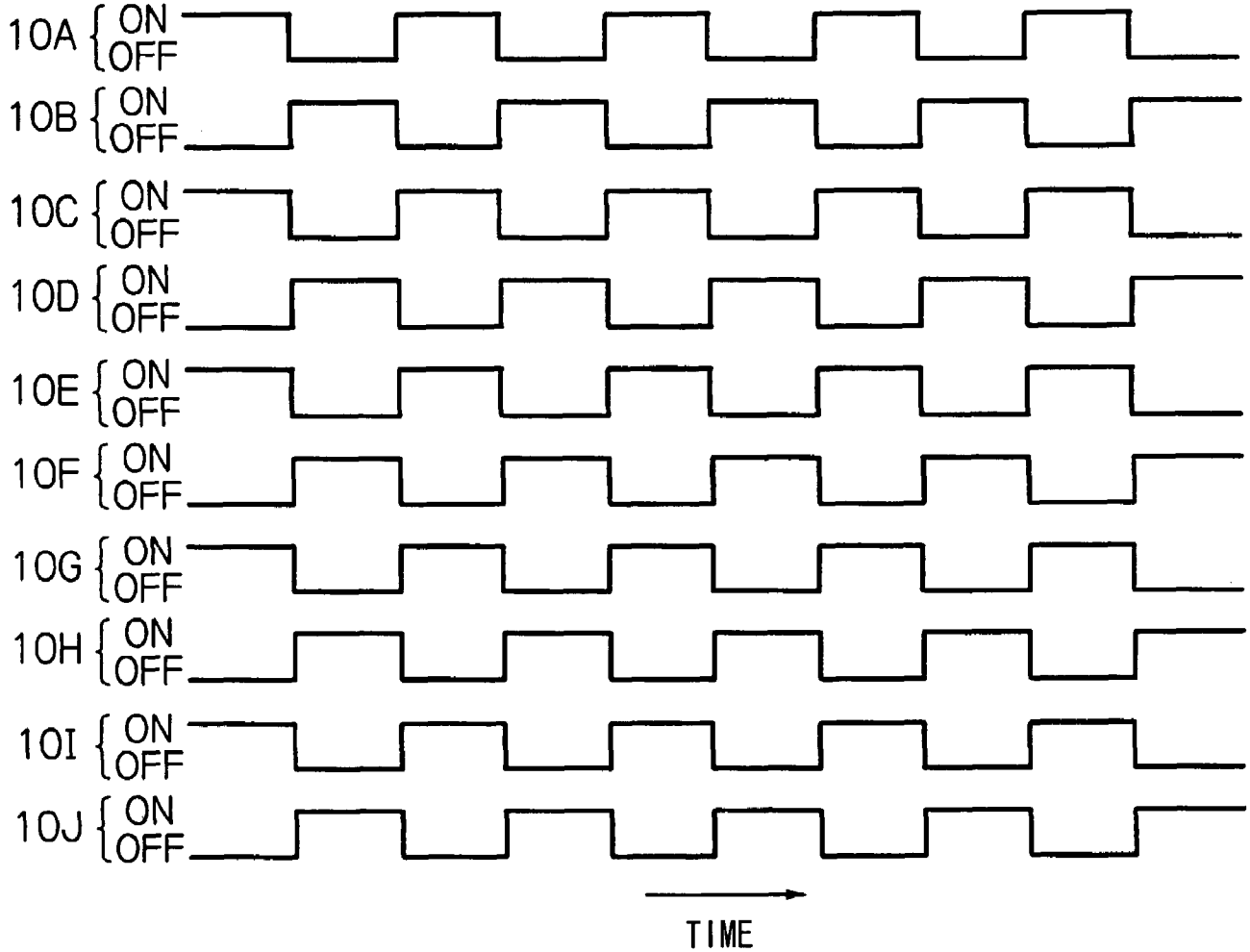
FIG. 11 is a time chart showing how each heating element is driven in order to achieve the driving pattern shown in FIG. 9A.

In this embodiment, as shown in FIG. 9A, regions that are not directly heated by any of the opposing heating elements 10 (other regions than hatched regions) and regions that are directly heated by the opposing heating elements 10 (hatched regions) are alternated without exception to form a checkered pattern. In other words, regions that are not directly heated by any of the opposing heating elements 10 (other regions than hatched regions) take up a half the matrix and are arranged at regular intervals. Each of these indirectly heated regions and surrounding regions make a square of 3×3=9 dots, an area A of FIG. 9A, which is shown in FIG. 10A. In the area A, 8 dots of regions 15B to 15I surround an indirectly heated region 15A. Of the regions 15B to 15I, four regions that are not adjacent from one another, namely, the four regions 15C, 15E, 15F and 15H above and below the region 15A and to the left and right of the region 15A are regions that are directly heated by their opposing heating elements (hatched regions). A method of driving the heating elements 10 in a manner that produces the matrix pattern of FIG. 9A is shown in a time chart of FIG. 11. As shown in FIG. 11, a group consisting of the heating elements 10A, 10C, 10E, 10G and 10I and a group consisting of the heating elements 10B, 10D, 10F, 10H and 10J alternately stop being driven to obtain the driving pattern shown in FIG. 9A. With this driving pattern, it is difficult to thermally activate all the regions by supplying the standard driving energy of prior art (100% pulse width) to each of the heating elements 10 that is to generate heat (see Comparative Example 2). Accordingly, the driving energy supplied in this embodiment to each heating element that is to generate heat is 1.25 times larger (pulse width 125%) than the standard driving energy. With the 125% pulse width, the heat-sensitive adhesive layer 1*a* of the heat-sensitive adhesive sheet 1 is thermally activated throughout the entire surface as shown in FIG. 9B (hatched regions in FIG. 9B represent thermally activated regions).

In this embodiment too, the region 15A at the center is thermally activated by heat transmitted from the surroundings (ranges 15C', 15E', 15F' and 15H' circled in the drawing) as schematically shown in FIG. 10B. Whereas the first embodiment shown in FIGS. 4A and 4B activates one central region 15A with heat transmitted from the eight surrounding regions 15B to 15I, this embodiment activates one central region 15A with heat transmitted from the four surrounding regions 15C, 15E, 15F and 15H. In order to achieve thorough thermal activation, the pulse width of the driving energy supplied to the heating elements 10 is set larger than in the first embodiment at 125%. Although the region 15A in FIG. 10B has a blanc portion (non-activated portion) in the middle, it is simply a result of marking the heat conductive ranges 15C', 15E', 15F' and 15H' with perfect circles for easy understanding, and the heat actually spreads in a more complicated pattern, activating every region throughout.

FIG. 10B only shows heat transmitted to the region 15A at the center from the surroundings (ranges 15C', 15E', 15F' and 15H' circled in the drawing). Similarly, the regions 15B, 15D, 15G and 15I that are not directly heated by any of the opposing heating elements 10 are activated by heat transmitted from their respective surrounding regions.

As has been described, according to this embodiment, a half of the entire region is not directly heated by any of the opposing heating elements 10 as shown in FIG. 9A. The activation ratio is therefore 50%. With the 50% activation ratio, the sum of energy given to all the heating elements 10 in this embodiment is smaller than that of prior art despite the fact that the driving energy (pulse width) supplied in this embodiment to each of the heating elements 10 is 125%. The present invention thus includes, in addition to a case where the standard driving energy of prior art (100% pulse width) is supplied to each of the heating elements 10, a case in which a larger amount of driving energy than the standard driving energy (a pulse width larger than 100%) is balanced by a greatly cut activation ratio so that, on the whole, the sum of energy for thermally activating the heat-sensitive adhesive layer 1*a* of one heat-sensitive adhesive sheet 1 throughout the entire surface is smaller than in prior art.

FIG. 6 shows that this embodiment provides sticking power that equals the one in the prior art example as does the first embodiment. It means that this embodiment too is successful in thermally activating the entire surface of the heat-sensitive adhesive layer 1*a*.

FIG. 7 shows that this embodiment is even faster than the first embodiment in activation speed at all of the five different standard pulse widths. This is because the second embodiment having a large pulse width (125%) but a significantly small activation ratio (50%) finishes thermal activation in an even shorter period of time if the electric current consumption is the same. The electric current consumption in this embodiment can be reduced by keeping the activation speed constant.

FIG. 8 shows that the second embodiment is even longer than the first embodiment in total activation length at all the five different standard pulse widths. This is because thermal activation in the second embodiment having a large pulse width (125%) but a significantly small activation ratio (50%) can last longer while consuming the same amount of electric current on a power source (battery) of the same capacity. The electric current consumption in this embodiment can be reduced by keeping the total activation length constant.

The two embodiments described above show driving patterns in which regions that are not directly heated by any of the opposing heating elements 10 are arranged regularly, but the present invention is not limited to these driving patterns and can employ an arbitrary driving pattern. In other words, regions that are not directly heated by any of the opposing heating elements 10 may be arranged at random. However, as described, at least 4 non-adjacent regions out of 8 dots of regions surrounding an indirectly heated region should be regions that are directly heated by their opposing heating elements in order to thermally activate the entire surface throughout while keeping the sum of energy smaller than in prior art.

Next, many comparative examples in which various driving patterns and driving energy are experimented will be described. Each comparative example employs the same printer for a heat-sensitive adhesive sheet (see FIG. 1) that is used in the first and second embodiments to perform the thermal activation described above. The difference between the comparative examples and the embodiments is that the driving pattern and driving energy of the heating elements 10 are set differently. Given below is a description on the driving pattern and driving energy for thermal activation in each comparative example. Other aspects of the thermal activation method, the structure of the thermal activation device, and the like are identical with those in the first and second embodiments and descriptions thereof are omitted here.

Comparative Example 1

Figure 12:
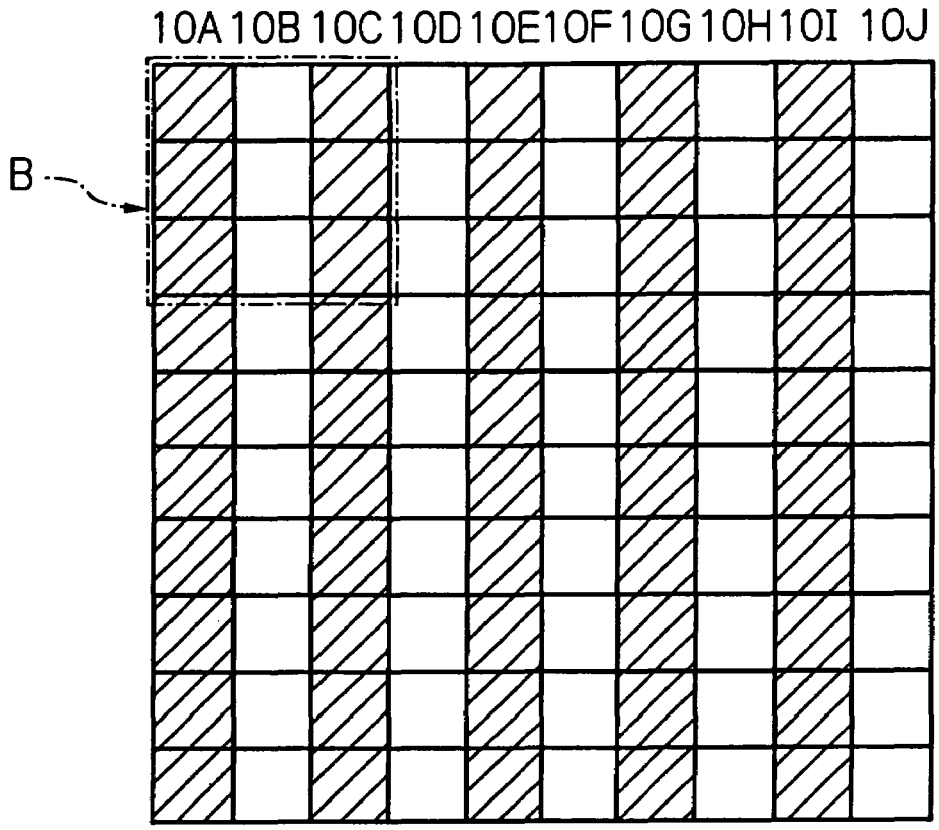
FIGS. 12A and 12B are, respectively, a schematic diagram showing in the form of matrix a driving pattern of a thermal activation method according to Comparative Example 1 and a schematic diagram showing a part of FIG. 12A to illustrate which region is activated.
Figure 12:
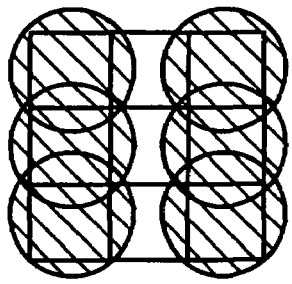

Comparative Example 1 shown in FIGS. 12A and 12B places vertical columns of regions that are not directly heated by any of the opposing heating elements 10 and vertical columns of directly heated regions alternately. This driving pattern is obtained by keeping the heating elements 10B, 10D, 10F, 10H and 10J undriven, or by not providing the heating elements 10B, 10D, 10F, 10H and 10J in the first place, while driving the heating elements 10A, 10C, 10E, 10G and 10I all the time. Having a pulse width of 100% and an activation ratio of 50%, Comparative Example 1 can cut the sum of driving energy but is greatly reduced in sticking power as shown in FIG. 6. This is because, as is obvious from FIG. 12B which shows an area B (a square area composed of 3×3=9 dots) in FIG. 12A, there are portions where thermal activation is insufficient and adhesion is weak.

Comparative Example 2

Figure 13:
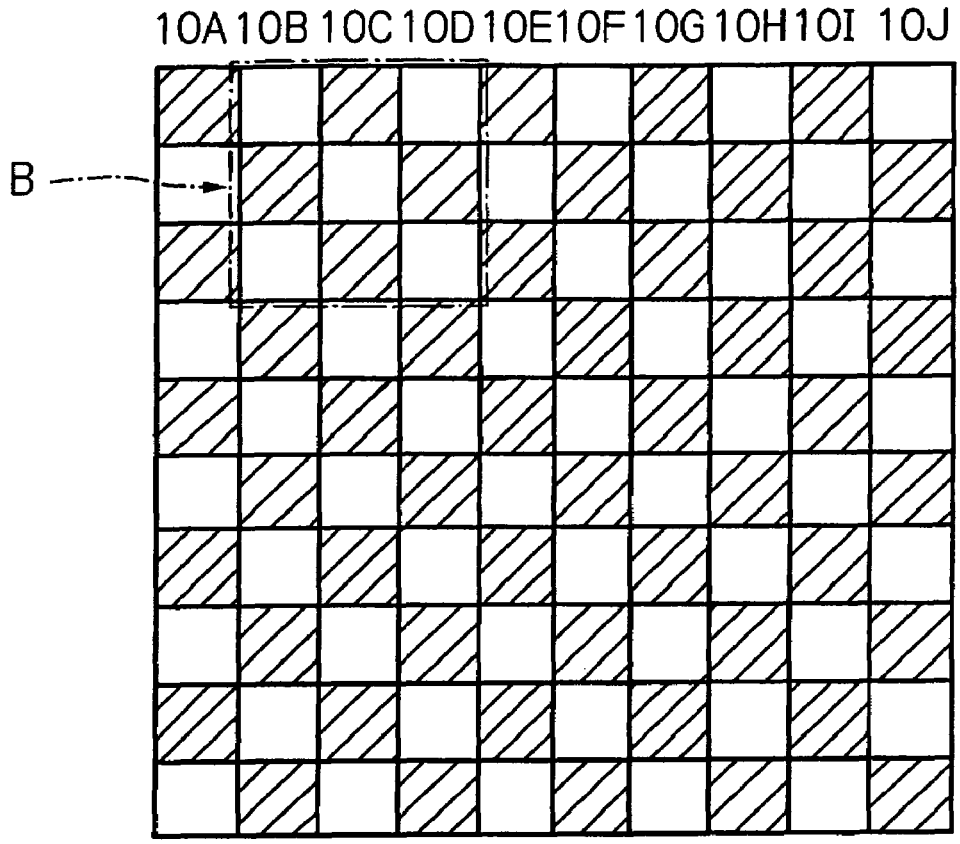
FIGS. 13A and 13B are, respectively, a schematic diagram showing in the form of matrix a driving pattern of a thermal activation method according to Comparative Example 2 and a schematic diagram showing a part of FIG. 13A to illustrate which region is activated.
Figure 13:
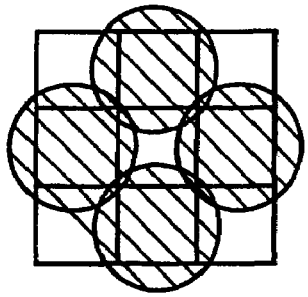

Comparative Example 2 shown in FIGS. 13A and 13B employs the same driving pattern as the second embodiment shown in FIGS. 9A and 9B to FIG. 11, whereas the standard driving energy (100% pulse width) is supplied in Comparative Example 2 to each of the heating elements 10 that is to generate heat. Having a pulse width of 100% and an activation ratio of 50%, Comparative Example 2 can cut the sum of driving energy but is lower in sticking power than the first and second embodiments as shown in FIG. 6, though higher than Comparative Example 1. The adhesion is higher in this comparative example than in Comparative Example 1 since regions that are not directly heated by any of the opposing heating elements 10 are surrounded by regions that are directly heated by the opposing heating elements 10 in this embodiment. However, when FIG. 13B which shows an area B (a square area composed of 3×3=9 dots) in FIG. 13A is compared to FIG. 10B which illustrates the second embodiment, it is understood that FIG. 13B has portions where thermal activation is insufficient and adhesion is weak. It is difficult to decipher the difference between this comparative example and the first embodiment on schematic diagrams like FIGS. 13B and 4B. The difficulty notwithstanding, in this comparative example, portions where heat conductive ranges 15B' to 15I' overlap with one another are small and, in addition, no three of the heat conductive ranges overlap with one another unlike the first embodiment. Comparative Example 2 therefore cannot obtain the synergistic effect of heat from plural heating elements, and the extent of heat transmission varies greatly in practice. Thermal activation is insufficient in some places as a result. In order for the driving pattern shown in FIGS. 13A and 13B to obtain satisfactory sticking power, the pulse width has to be increased to 125% (see the second embodiment).

Comparative Example 3

Figure 14:
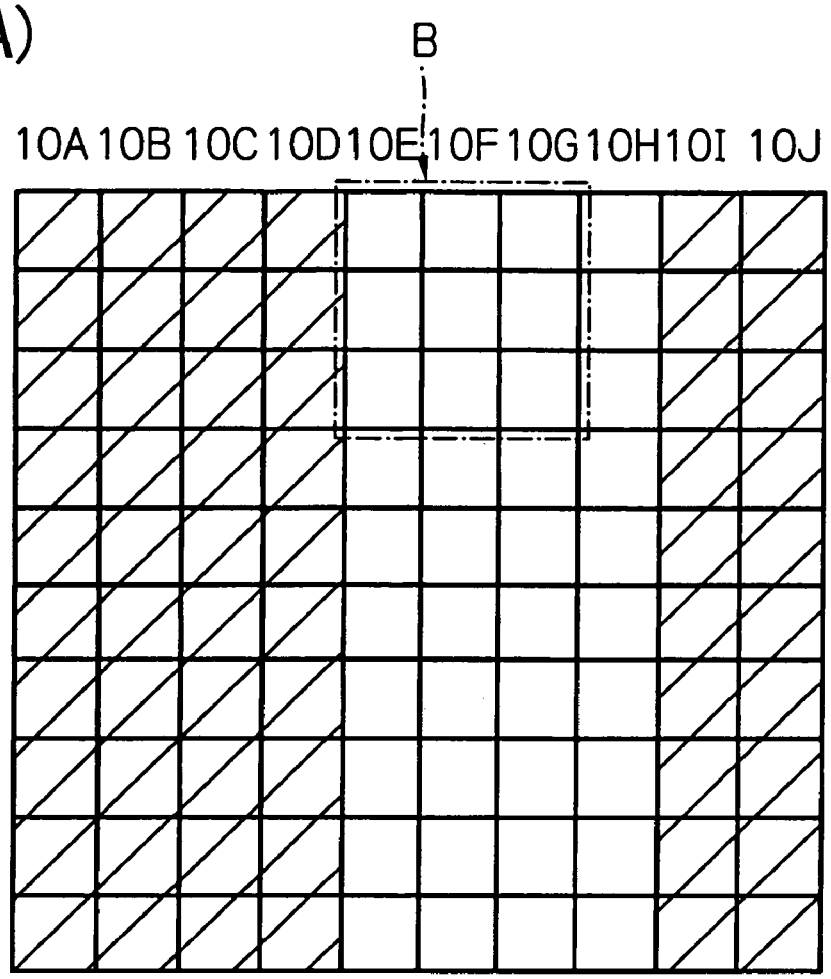
FIGS. 14A and 14B are, respectively, a schematic diagram showing in the form of matrix a driving pattern of a thermal activation method according to Comparative Example 3 and a schematic diagram showing a part of FIG. 14A to illustrate which region is activated.
Figure 14:
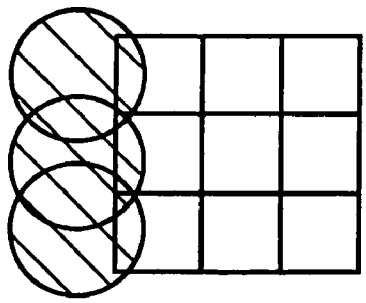

Comparative Example 3 shown in FIGS. 14A and 14B employs a driving pattern in which a 4-dot width vertical column of regions that are not directly heated by any of the opposing heating elements 10 is alternated with a 4-dot width vertical column of regions that are directly heated by the opposing heating elements. This driving pattern is a coarse, enlarged version of the driving pattern of Comparative Example 1. Having a pulse width of 100% and an activation ratio of 50%, Comparative Example 3 can cut the sum of driving energy but is greatly reduced in sticking power as shown in FIG. 6. This is because, as is obvious from FIG. 14B which shows an area B (a square area composed of 3×3=9 dots) in FIG. 14A, there are portions where thermal activation is insufficient and adhesion is weak.

Comparative Example 4

Figure 15:
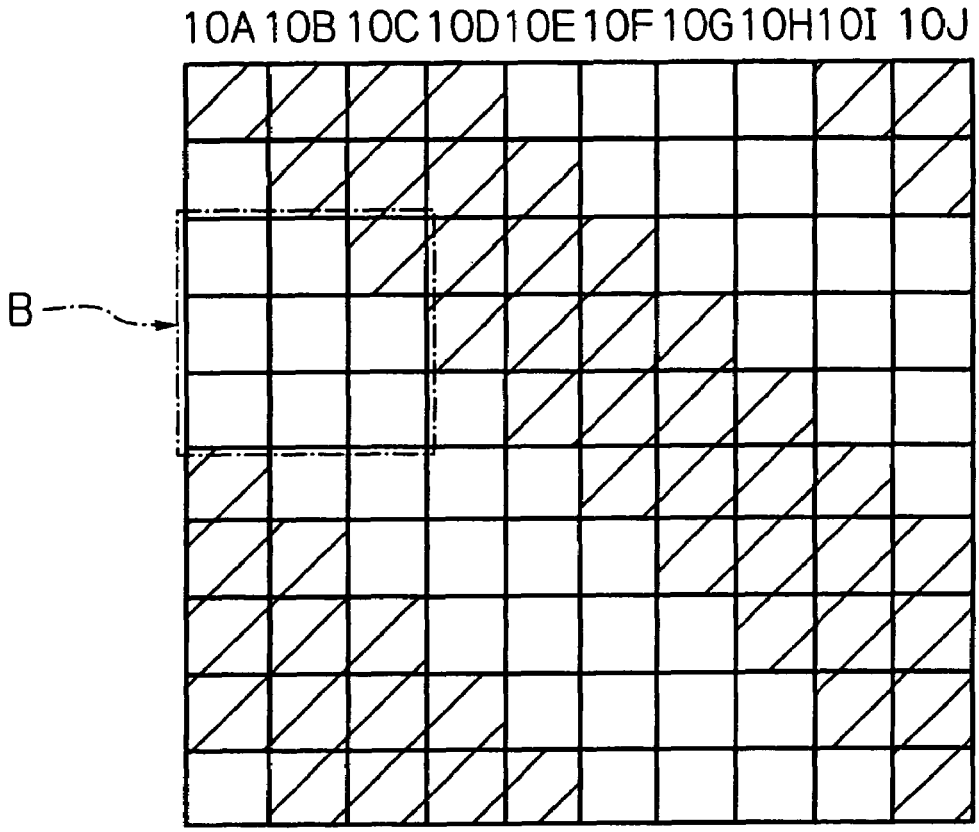
FIGS. 15A and 15B are, respectively, a schematic diagram showing in the form of matrix a driving pattern of a thermal activation method according to Comparative Example 4 and a schematic diagram showing a part of FIG. 15A to illustrate which region is activated.
Figure 15:
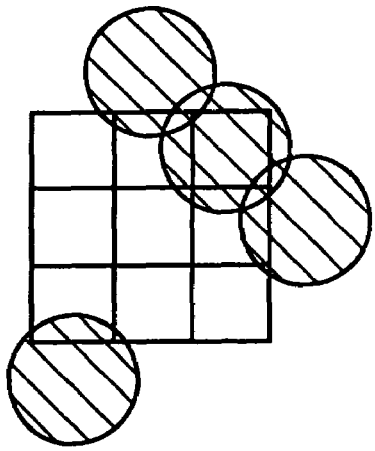

Comparative Example 4 shown in FIGS. 15A and 15B employs a driving pattern in which a 4-dot width oblique column of regions that are not directly heated by any of the opposing heating elements 10 is alternated with a 4-dot width oblique column of regions that are directly heated by the opposing heating elements. Having a pulse width of 100% and an activation ratio of 50%, Comparative Example 4 can cut the sum of driving energy but is greatly reduced in sticking power as shown in FIG. 6. This is because, as is obvious from FIG. 15B which shows an area B (a square area composed of 3×3=9 dots) in FIG. 15A, there are portions where thermal activation is insufficient and adhesion is weak.

Comparative Example 5

Figure 16:
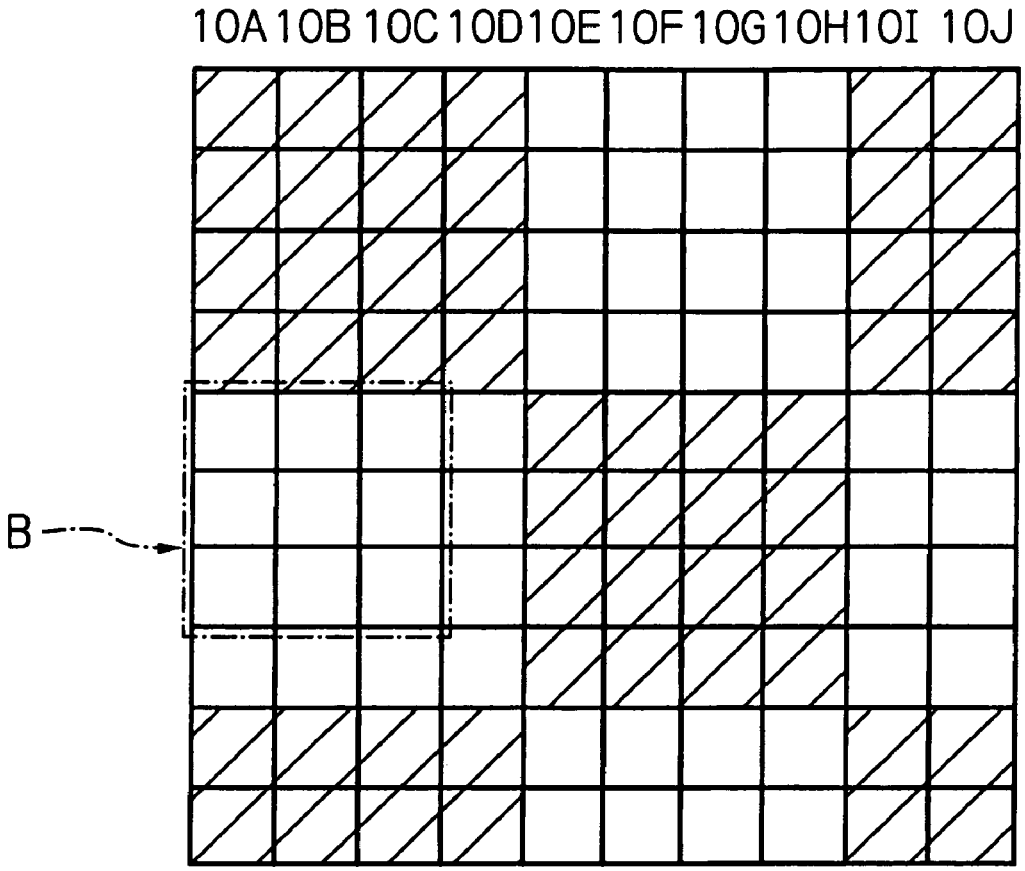
FIGS. 16A and 16B are, respectively, a schematic diagram showing in the form of matrix a driving pattern of a thermal activation method according to Comparative Example 5 and a schematic diagram showing a part of FIG. 16A to illustrate which region is activated.
Figure 16:
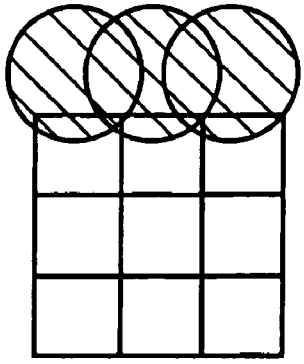

Comparative Example 5 shown in FIGS. 16A and 16B employs a driving pattern in which 4 dots of regions that are not directly heated by any of the opposing heating elements 10 is alternated in checkers with 4 dots of regions that are directly heated by the opposing heating elements. This driving pattern is a coarse, enlarged version of the driving pattern of Comparative Example 2. Having a pulse width of 100% and an activation ratio of 50%, Comparative Example 5 can cut the sum of driving energy but is greatly reduced in sticking power as shown in FIG. 6. This is because, as is obvious from FIG. 16B which shows an area B (a square area composed of 3×3=9 dots) in FIG. 16A, there are portions where thermal activation is insufficient and adhesion is weak.

Comparative Example 6

Figure 17:
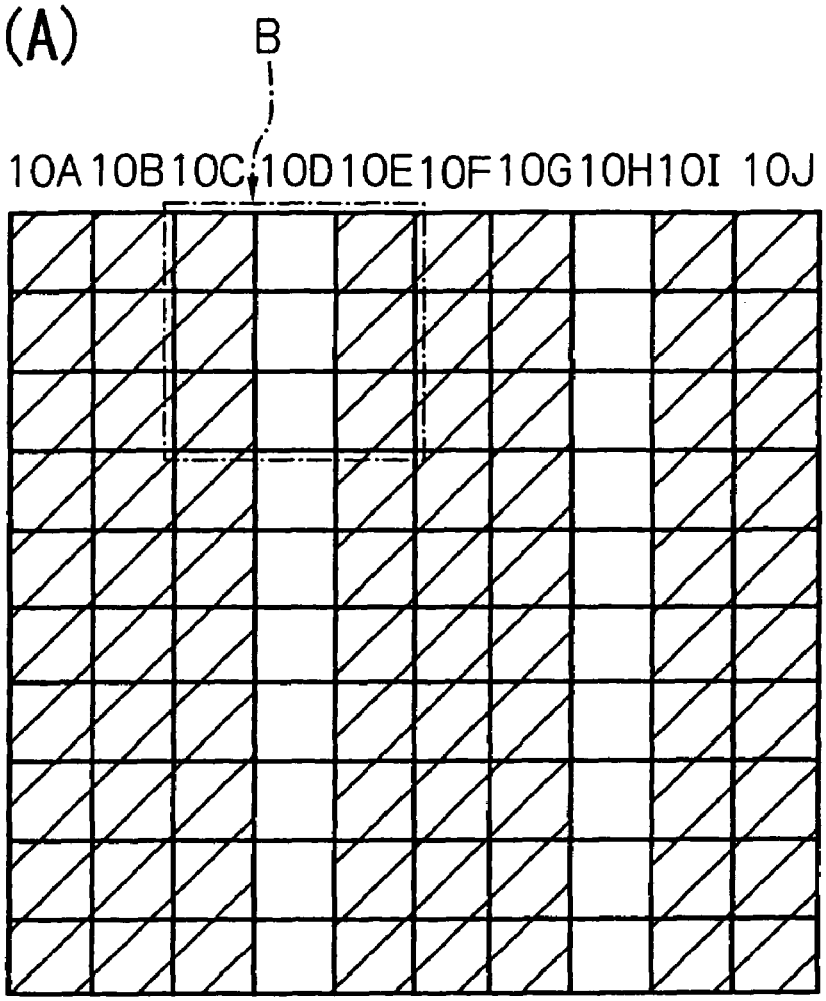
FIGS. 17A and 17B are, respectively, a schematic diagram showing in the form of matrix a driving pattern of a thermal activation method according to Comparative Example 6 and a schematic diagram showing a part of FIG. 17A to illustrate which region is activated.
Figure 17:
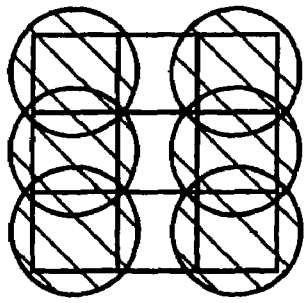

Comparative Example 6 shown in FIGS. 17A and 17B employs a driving pattern in which a 4-dot width vertical column of regions that are not directly heated by any of the opposing heating elements 10 is alternated with a 1-dot width vertical column of regions that are directly heated by the opposing heating elements. Having a pulse width of 100% and an activation ratio of 75%, Comparative Example 6 can cut the sum of driving energy but is low in sticking power as shown in FIG. 6. This is because, as is obvious from comparison between FIG. 17B which shows an area B (a square area composed of 3×3=9 dots) in FIG. 17A and FIG. 4B according to the first embodiment, for example, there are portions where thermal activation is insufficient and adhesion is weak.

Comparative Example 7

Figure 18:
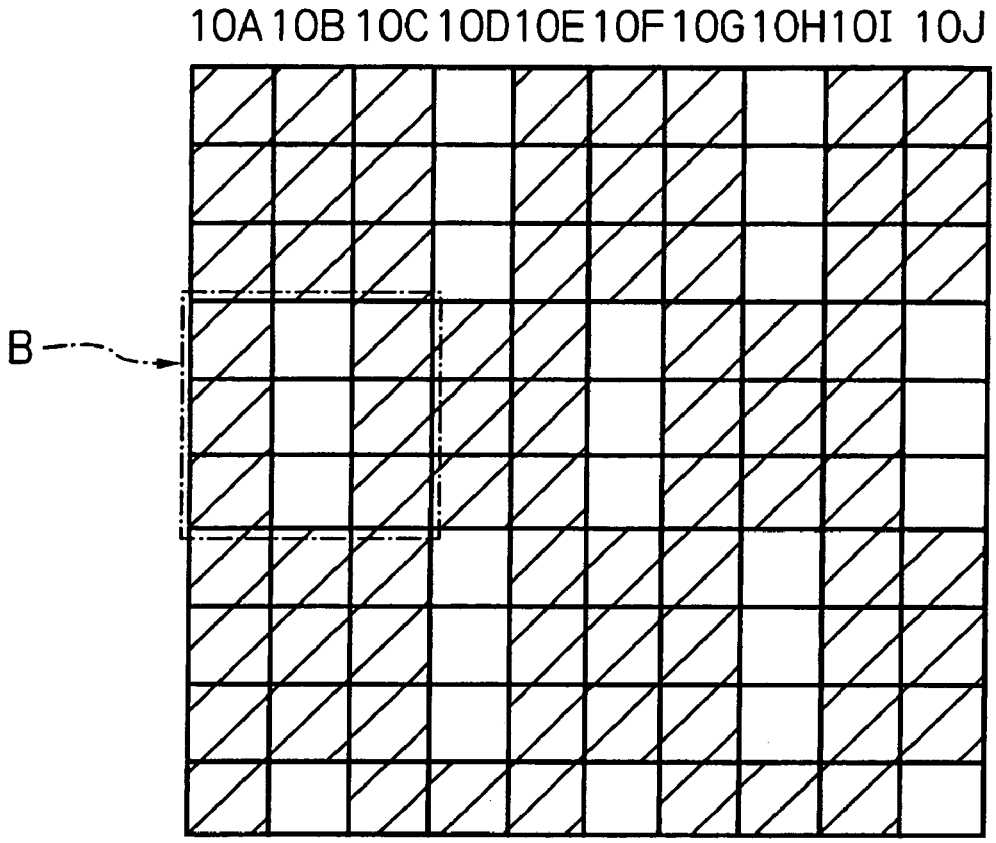
FIGS. 18A and 18B are, respectively, a schematic diagram showing in the form of matrix a driving pattern of a thermal activation method according to Comparative Example 7 and a schematic diagram showing a part of FIG. 18A to illustrate which region is activated.
Figure 18:
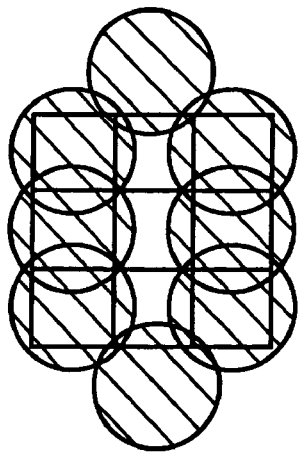

Comparative Example 7 shown in FIGS. 18A and 18B employs a driving pattern in which 4×4-dots of squares of regions that are not directly heated by any of the opposing heating elements 10 are arranged regularly sandwiching 1×3-dots of rectangles of regions that are directly heated by the opposing heating elements 10. Having a pulse width of 100% and an activation ratio of 75%, Comparative Example 7 can cut the sum of driving energy. As shown in FIG. 6, Comparative Example 7 is higher in sticking power than other comparative examples (Comparative Example 6, for instance), but is lower than the prior art example and the first and second embodiments. This is because, in Comparative Example 7, regions that are not directly heated by any of the opposing heating elements 10 are surrounded by regions that are directly heated by the opposing heating elements 10 as indicated by FIG. 18B which shows an area B (a square area composed of 3×3=9 dots) in FIG. 18A, and therefore the adhesion is stronger than in Comparative Example 6. On the other hand, compared to the first embodiment, the regions that are not directly heated by any of the opposing heating elements 10 take up a large area, which results in insufficient thermal activation and weak adhesion.

Comparative Example 8

Figure 19:
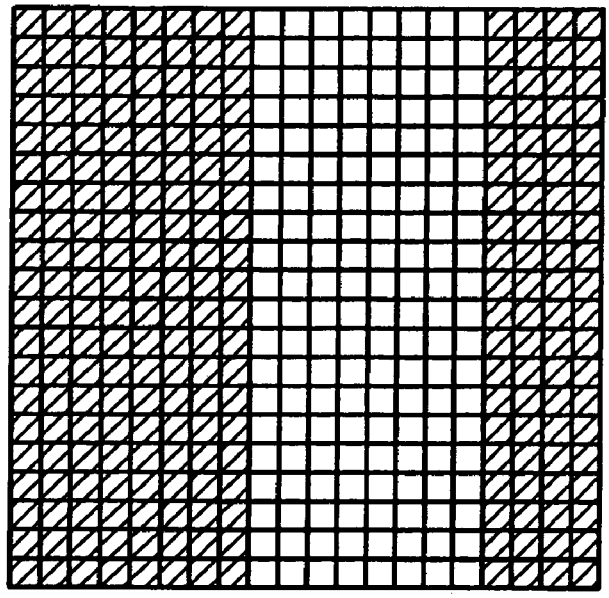
FIG. 19 is a schematic diagram showing in the form of matrix a driving pattern of a thermal activation method according to Comparative Example 8.

Comparative Example 8 shown in FIG. 19 employs a driving pattern in which an 8-dot width vertical column of regions that are not directly heated by any of the opposing heating elements 10 is alternated with an 8-dot width vertical column of regions that are directly heated by the opposing heating elements 10. This driving pattern is a coarse, enlarged version of the driving pattern of Comparative Example 3. Having a pulse width of 100% and an activation ratio of 50%, Comparative Example 8 can cut the sum of driving energy but is low in sticking power. This is because regions that are not directly heated by any of the opposing heating elements 10 are too wide, and have portions where thermal activation hardly takes place and substantially no adhesion is developed.

Comparative Example 9

Figure 20:
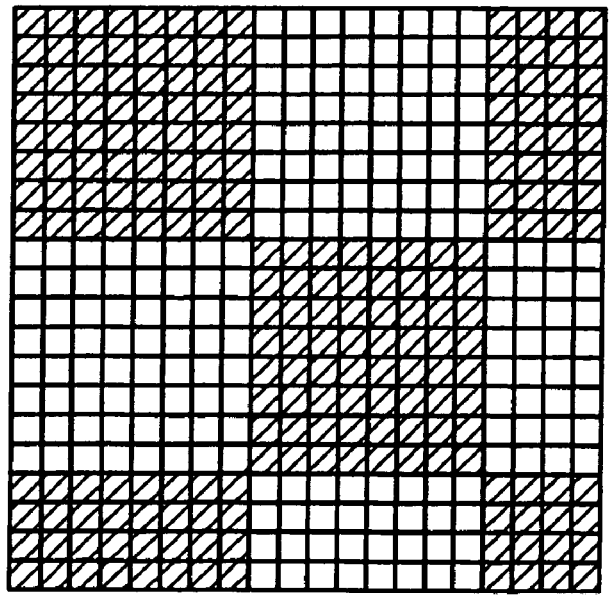
FIG. 20 is a schematic diagram showing in the form of matrix a driving pattern of a thermal activation method according to Comparative Example 9.

Comparative Example 9 shown in FIG. 20 employs a driving pattern in which 8 dots of regions that are not directly heated by any of the opposing heating elements 10 is alternated in checkers with 8 dots of regions that are directly heated by the opposing heating elements 10. This driving pattern is a coarse, enlarged version of the driving pattern of Comparative Example 5. Having a pulse width of 100% and an activation ratio of 50%, Comparative Example 9 can cut the sum of driving energy but is low in sticking power. This is because regions that are not directly heated by any of the opposing heating elements 10 are too wide, and have portions where thermal activation hardly takes place and substantially no adhesion is developed.

Comparative Example 10

Figure 21:
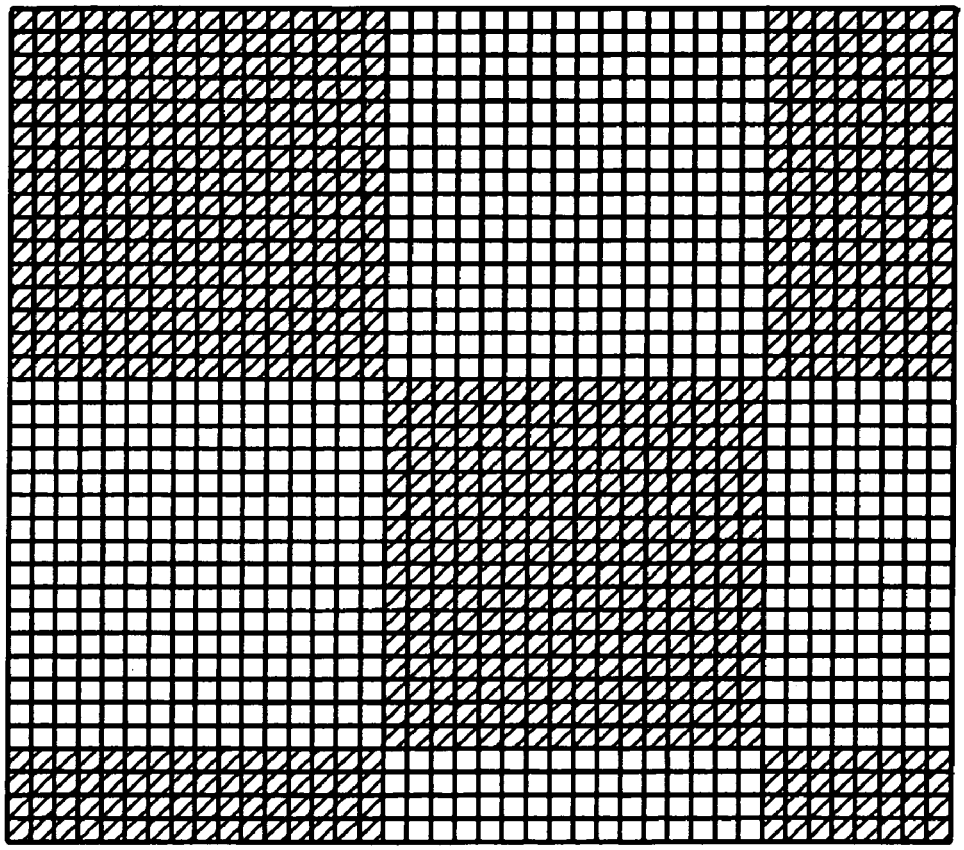
FIG. 21 is a schematic diagram showing in the form of matrix a driving pattern of thermal activation methods according to Comparative Examples 10 and 11.

Comparative Example 10 shown in FIG. 21 employs a driving pattern in which 16 dots of regions that are not directly heated by any of the opposing heating elements 10 is alternated in checkers with 16 dots of regions that are directly heated by the opposing heating elements 10. This driving pattern is a more coarse, enlarged version of the driving pattern of Comparative Example 9. Having a pulse width of 100% and an activation ratio of 50%, Comparative Example 10 can cut the sum of driving energy but is low in sticking power. This is because regions that are not directly heated by any of the opposing heating elements 10 are too wide, and have portions where thermal activation hardly takes place and substantially no adhesion is developed.

Comparative Example 11

Comparative Example 11 is similar to Comparative Example 10 in that the driving pattern shown in FIG. 21 is employed, but has a pulse width of 125%. Having a pulse width of 125% and an activation ratio of 50%, Comparative Example 11 can cut the sum of driving energy but is as low as Comparative Example 10 in sticking power. This is because regions that are not directly heated by any of the opposing heating elements 10 are too wide, and increasing the driving energy to a small degree does not make a difference. As a result, portions where thermal activation hardly takes place and adhesion is substantially zero are created.

Comparative Example 12

Figure 22:
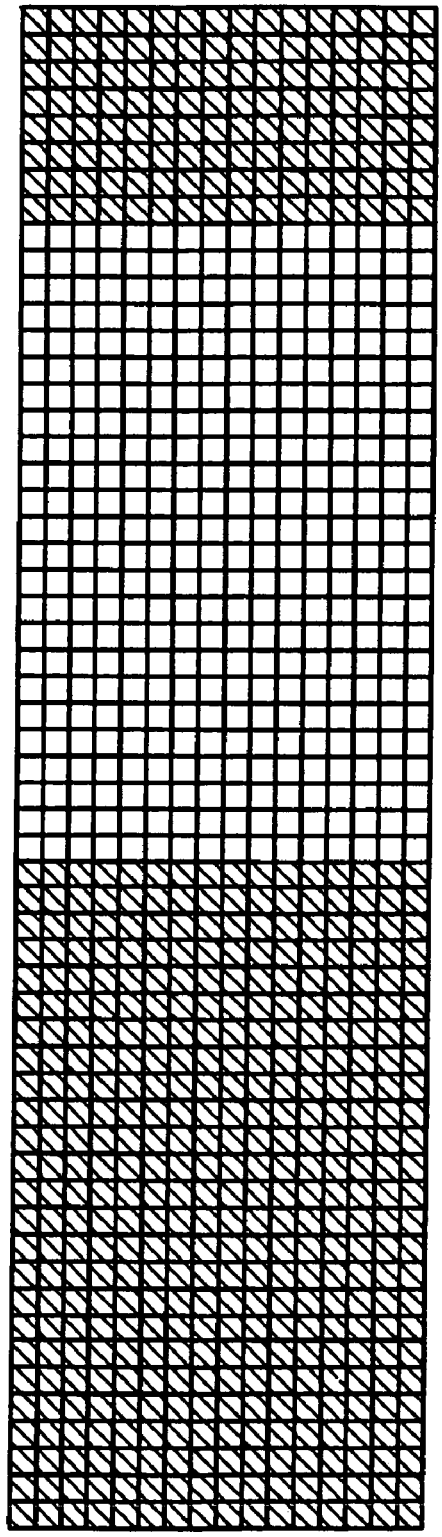
FIG. 22 is a schematic diagram showing in the form of matrix a driving pattern of a thermal activation method according to Comparative Example 12.

Comparative Example 12 shown in FIG. 22 employs a driving pattern in which a 24-dot width vertical column of regions that are not directly heated by any of the opposing heating elements 10 is alternated with a 24-dot width vertical column of regions that are directly heated by the opposing heating elements. This driving pattern is a more coarse, enlarged version of the driving pattern of Comparative Example 11. Having a pulse width of 100% and an activation ratio of 50%, Comparative Example 12 can cut the sum of driving energy but is lower in sticking power than the prior art example and the first and second embodiments. This is because regions that are not directly heated by any of the opposing heating elements 10 are too wide, and have portions where thermal activation hardly takes place and substantially no adhesion is developed.

According to FIG. 6, the sticking power of Comparative Example 12 is, though insufficient, higher than that of other comparative examples. This is probably because Comparative Example 12 has a wide area where the adhesion is satisfactory, and the adhesive layer exhibits fairy strong adhesion in some places. Depending on the peeling direction and where to start peeling in the peeling experiment, Comparative Example 12 may provide relatively high sticking power as shown in FIG. 6. In other words, the sticking power of Comparative Example 12 could be reduced far lower than shown in FIG. 6 with a slight change in peeling direction or where to start peeling. Incidentally, a change in peeling direction or where to start peeling hardly causes the sticking power to fluctuate in the first and second embodiments unlike Comparative Example 12, and the first and second embodiments can always provide steady sticking power.

It is clear that, compared to the above-described Comparative Examples 1 to 12, the first and second embodiments of the present invention have an excellent effect in that satisfactory sticking power equal to the sticking power of the prior art example is obtained while cutting the sum of driving energy. In order to obtain such favorable results, at least 4 non-adjacent regions out of 8 dots of regions surrounding an indirectly heated region should be regions that are directly heated by their opposing heating elements as in the first and second embodiments.

The description given above on the prior art example, the embodiments and the comparative examples takes as an example a case of making a heat-sensitive adhesive sheet develop adhesion throughout the entire surface. However, the present invention is also applicable to a case of creating an adhesive portion and a non-adhesive portion in one heat-sensitive adhesive sheet. To elaborate, a thermal activation method as those described above is applied to a region that is to develop adhesion whereas a heating element opposite to a region that is not to develop adhesion is not driven at all in order to avoid thermally activating a heat-sensitive adhesive layer in the regions. A heat-sensitive adhesive sheet having an adhesive portion and a non-adhesive portion sheet thus can serve as a label and a copy, for example, so that the adhesive portion is stuck fast to an article as a label and the non-adhesive portion alone is readily torn off as a copy of the label.

What is claimed is:

1. A thermal activation method for thermally activating a heat-sensitive adhesive layer of a heat-sensitive adhesive sheet, the method comprising:

providing a thermal head having a plurality of heating elements that can be selectively driven independently from one another during a driving operation to directly heat, and thereby activate, regions of a heat-sensitive adhesive layer of a heat-sensitive adhesive sheet while the heat-sensitive adhesive sheet is moved relative to the thermal head with the heating elements disposed in opposing relation to the respective regions of the heat-sensitive adhesive layer;

selectively driving the heating elements of the thermal head in synchronization with movement of the heat-sensitive adhesive sheet relative to the thermal head to activate the regions of the heat-sensitive adhesive layer of the heat-sensitive adhesive sheet while temporarily stopping, at a preselected timing of the driving operation, the driving of a preselected one of the heating elements so that a correspondingly opposing preselected region of the heat-sensitive adhesive layer is not directly heated, and thereby not directly activated, by the preselected heating element; and activating the entire preselected region of the heat-sensitive adhesive layer with heat transmitted from surrounding directly heated regions of the heat-sensitive adhesive layer of the heat-sensitive adhesive sheet.

2. A thermal activation method according to claim 1; wherein the preselected region of the heat-sensitive adhesive sheet is disposed at a location of the heat-sensitive adhesive layer and has a size that allows the preselected region to be activated with the heat transmitted from surrounding directly heated regions of the heat-sensitive adhesive layer.

3. A thermal activation method according to claim 1; wherein a totality of a driving energy applied to the heat-sensitive adhesive sheet during a driving operation is reduced by setting a driving energy of each of the heating elements, except for the preselected heating element, equal to a standard driving energy corresponding to a driving energy that would be applied to each of the heating elements if all of the heating elements were driven, and by reducing an area ratio of the regions of the heat-sensitive adhesive layer of the heat-sensitive adhesive sheet that are heated by the respective opposing heating elements.

4. A thermal activation method according to claim 1; wherein a totality of a driving energy applied to the heat-sensitive adhesive sheet during a driving operation is reduced by setting a driving energy of each of the heating elements, except for the preselected heating element, to be larger than a standard driving energy corresponding to a driving energy that would be applied to each of the heating elements if all of the heating elements were driven, and by reducing an area ratio of the regions of the heat-sensitive adhesive layer of the heat-sensitive adhesive sheet that are heated by the respective opposing heating elements.

5. A thermal activation method according to claim 1; wherein when one of the regions of the heat-sensitive adhesive layer of the heat-sensitive adhesive sheet corresponds to a designated region that does not require activation, the heating element opposing the designated region is not driven and no portion of the heat-sensitive adhesive layer corresponding to the designated region is thermally activated.

6. A thermal activation device for a heat-sensitive adhesive sheet, comprising:

a thermal head having a linear array of heating elements configured to be selectively driven independently from one another during a driving operation to directly heat, and thereby activate, regions of a heat-sensitive adhesive layer of a heat-sensitive adhesive sheet while moving the heat-sensitive adhesive sheet relative to the thermal head with the heating elements disposed in opposing relation to the respective regions of the heat-sensitive adhesive layer;

a conveying device for moving the heat-sensitive adhesive sheet relative to the thermal head in a direction intersecting a direction in which the heating elements of the thermal head are aligned; and a control device that selectively drives the heating elements of the thermal head in synchronization with movement of the heat-sensitive adhesive sheet relative to the thermal head to activate the regions of the heat-sensitive adhesive layer of the heat-sensitive adhesive sheet while temporarily stopping, at a preselected timing of the driving operation, the driving of a preselected one of the heating elements so that a correspondingly opposing preselected region of the heat-sensitive adhesive layer is not directly heated, and thereby not directly activated, by the preselected heating element, and so that an entire surface of the preselected region of the heat-sensitive adhesive layer is allowed to be activated with heat transmitted from surrounding directly heated regions of the heat-sensitive adhesive layer of the heat-sensitive adhesive sheet.

7. A thermal activation device according to claim 6; wherein the preselected region of the heat-sensitive adhesive sheet is disposed at a location of the heat-sensitive adhesive layer and has a size that allows the preselected region to be activated with the heat transmitted from surrounding directly heated regions of the heat-sensitive adhesive layer.

8. A thermal activation device according to claim 6; wherein the control device selectively drives the heating elements of the thermal head so that a totality of a driving energy applied during a driving operation is reduced by setting a driving energy of each of the heating elements, except for the preselected heating element, equal to a standard driving energy corresponding to a driving energy that would be applied to each of the heating elements if all of the heating elements were driven, and by reducing an area ratio of the regions of the heat-sensitive adhesive layer of the heat-sensitive adhesive sheet that are heated by the respective opposing heating elements.

9. A thermal activation device according to claim 6; wherein the control device selectively drives the heating elements of the thermal head so that a totality of a driving energy applied during a driving operation is reduced by setting a driving energy of each of the heating elements, except for the preselected heating element, larger than a standard driving energy corresponding to a driving energy that would be applied to each of the heating elements if all of the heating elements were driven, and by reducing an area ratio of the regions of the heat-sensitive adhesive layer of the heat-sensitive adhesive sheet that are heated by the respective opposing heating elements.

10. A thermal activation method for thermally activating a heat-sensitive adhesive layer of a heat-sensitive adhesive sheet, the method comprising:

providing a thermal head having a plurality of heating elements configured to be selectively driven independently from one another during a driving operation to directly heat, and thereby thermally activate, regions of a heat-sensitive adhesive layer of a heat-sensitive adhesive sheet while the heat-sensitive adhesive sheet is moved relative to the thermal head with the heating elements disposed in opposing relation to the respective regions of the heat-sensitive adhesive layer; and selectively driving all but at least one of the heating elements of the thermal head so that (a) a preselected region of the heat-sensitive adhesive layer disposed in opposing relation to each non-driven heating element is not directly heated, and thereby not directly thermally activated, by the non-driven heating element, (b) the regions of the heat-sensitive adhesive layer disposed in opposing relation to the respective driven heating elements are directly heated, and thereby directly thermally activated, by the respective driven heating elements, and (c) the entirety of each preselected region of the heat-sensitive adhesive layer opposed to a non-driven heating element is thermally activated with heat transmitted from surrounding directly heated regions of the heat-sensitive adhesive layer of the heat-sensitive adhesive sheet.

11. A thermal activation method according to claim 10; wherein the preselected region of the heat-sensitive adhesive sheet is disposed at a location of the heat-sensitive adhesive layer and has a size that allows the preselected region to be activated with the heat transmitted from surrounding directly heated regions of the heat-sensitive adhesive layer.

12. A thermal activation method according to claim 10; wherein a totality of a driving energy applied to the heat-sensitive adhesive sheet during a driving operation is reduced by setting a driving energy of each of the heating elements, except for the preselected heating element, equal to a standard driving energy corresponding to a driving energy that would be applied to each of the heating elements if all of the heating elements were driven, and by reducing an area ratio of the regions of the heat-sensitive adhesive layer of the heat-sensitive adhesive sheet that are heated by the respective opposing heating elements.

13. A thermal activation method according to claim 10; wherein a totality of a driving energy applied to the heat-sensitive adhesive sheet during a driving operation is reduced by setting a driving energy of each of the heating elements, except for the preselected heating element, to be larger than a standard driving energy corresponding to a driving energy that would be applied to each of the heating elements if all of the heating elements were driven, and by reducing an area ratio of the regions of the heat-sensitive adhesive layer of the heat-sensitive adhesive sheet that are heated by the respective opposing heating elements.

14. A thermal activation method according to claim 10; wherein when one of the regions of the heat-sensitive adhesive layer of the heat-sensitive adhesive sheet corresponds to a designated region that does not require activation, the heating element opposing the designated region is not driven and no portion of the heat-sensitive adhesive layer corresponding to the designated region is thermally activated.

* * * * *